US008054151B2

(12) United States Patent
Kobayashi et al.

(10) Patent No.: US 8,054,151 B2
(45) Date of Patent: Nov. 8, 2011

(54) COMPACT INDUCTOR AND A METHOD FOR MANUFACTURING THE SAME

(75) Inventors: Nobuyuki Kobayashi, Nagoya (JP); Kazuyuki Mizuno, Nagoya (JP); Natsumi Shimogawa, Nagoya (JP); Shuichi Ozawa, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 3 days.

(21) Appl. No.: 12/691,959

(22) Filed: Jan. 22, 2010

(65) Prior Publication Data

US 2010/0194511 A1 Aug. 5, 2010

Related U.S. Application Data

(60) Provisional application No. 61/158,028, filed on Mar. 6, 2009.

(30) Foreign Application Priority Data

Jan. 22, 2009 (JP) ..... 2009-012145
Jan. 21, 2010 (JP) ..... 2010-011324

(51) Int. Cl.
*H01F 27/02* (2006.01)

(52) U.S. Cl. ..... 336/83

(58) Field of Classification Search ..... 336/65, 336/83, 90, 96, 200, 220–223, 233–234
See application file for complete search history.

(56) References Cited

U.S. PATENT DOCUMENTS 6,661,328 B2 * 12/2003 Inoue et al. ..... 336/233
6,825,746 B2 * 11/2004 Otsuka et al. ..... 336/83
7,230,514 B2 * 6/2007 Brunner ..... 336/90
7,859,377 B2 * 12/2010 Kawarai ..... 336/83

FOREIGN PATENT DOCUMENTS

JP 2001-267129 9/2001

* cited by examiner

*Primary Examiner* — Tuyen Nguyen
(74) *Attorney, Agent, or Firm* — Burr & Brown

(57) ABSTRACT

A compact inductor comprises a coil, a coil-burying body, and a body for a closed magnetic circuit. The coil-burying body is a fired porous ceramic body having a first magnetic permeability, in which the coil is buried. In the coil-burying body, "a through-hole 12*a* passing through inside of the coil along an axis of the coil" is formed. The body for a closed magnetic circuit is a fired dense ceramic body having a second magnetic permeability greater than the first magnetic permeability. The body for a closed magnetic circuit is arranged closely/densely at an outer circumference portion of the coil-burying body and in the through-hole. A magnetic path is therefore formed mainly within the body for a closed magnetic circuit, and the magnetic flux density is reduced in an area close to the coil. Accordingly, an inductor having the excellent superimposed DC current characteristic is provided.

8 Claims, 17 Drawing Sheets

COMPACT INDUCTOR AND A METHOD FOR MANUFACTURING THE SAME

FIELD OF THE INVENTION

The present invention relates to a compact inductor, such as a compact power inductor used for a power supply circuit and the like, and a method for manufacturing the same.

BACKGROUND OF THE INVENTION

Conventionally, a compact power inductor has been known. The compact power inductor is used for realizing functions such as suppressing noise in a signal, rectification, smoothing signals, for example, in a power supply circuit for semiconductors, and a power circuit such of a DC-DC convertor, and the like. A wirewound inductor and a layered (multi-layer) inductor are known, as such a compact power inductor.

The compact power inductor needs to be compact, and to have a large inductance, a low resistance, and an excellent superimposed DC current characteristic, and so on. It is said that the superimposed DC current characteristic is excellent, if a magnetic saturation does not occur (magnetic permeability in a magnetic path does not become small), and accordingly, its inductance does not decrease, even when a relatively large DC current signal is applied to a coil in addition to an AC current signal (i.e., even when a large superimposed DC current is flowed in the coil).

As shown in FIG. 27 showing a cross sectional view of a conventional wirewound inductor 100, the conventional wirewound inductor 100 includes a core (magnetic core) 101 and a coil (conductive wire) 102. The coil 102 is helically wound around the core 101. When a current is flowed in the coil 102 of the wirewound inductor 100, the magnetic path is formed as shown by a dashed line in FIG. 27. The magnetic path passes through a space. That is, the wirewound inductor 100 has an open magnetic circuit configuration. Accordingly, since the magnetic flux density is hardly excessive and the magnetic saturation scarcely occurs, the superimposed DC current characteristic of the wirewound inductor 100 is therefore relatively good. However, in order to increase the inductance of the wirewound inductor 100, the fine conductive wire 102 needs to be wound around the core 101 with a large number of turns. This causes a problem that the resistance becomes large. Moreover, manufacturing processes for the wirewound inductor 100 are complicated, and there is a limit to downsizing the wirewound inductor 100.

To the contrary, a conventional layered inductor 110, as shown in FIG. 28 showing a perspective view of the inductor 110 and FIG. 29 showing a cross sectional view of the inductor 110, comprises a magnetic body 111, a coil 112 buried in the magnetic body 111, and a pair of electrode terminals 113. The coil 112 is formed of thin plate-like conductors 112*a*, each of which is formed to have a predetermined shape in each of layers, and conductors 112*b* in the via holes electrically connecting between the plate-like conductors 112*a* of the layers in a vertical direction. The pair of electrode terminals 113 are formed at both end portions of the magnetic body 111.

When a current is flowed in the coil 112 of the layered inductor 110, the magnetic path is formed as shown by a dashed line in FIG. 29. This magnetic path passes through the magnetic body 111 only. That is, the layered inductor 110 has a closed magnetic circuit configuration. Accordingly, since the layered inductor 110 has a high inductance even if a number of turns of the coil 112 is relatively small, the inductor 110 can decrease its resistance and be downsized. However, as schematically shown in FIG. 30, the magnetic flux density becomes extremely large in the neighborhood of the coil 112, when a current is flowed in the coil 112. Accordingly, the superimposed DC current characteristic of the layered inductor 110 is not good, because the magnetic saturation easily occurs.

FIG. 31 shows a cross sectional view of "a conventional layered inductor 120" coping with the problem described above. The layered inductor 120 comprises a first outer body 121 made of ceramic, a resin layer 122, an intermediate body 123, a resin layer 124, a second outer body 125, a core 126, and a helically wound coil conductor 127. The core 126 is formed at a central portion of the intermediate body 123 and of the second outer body 125. The coil conductor 127 is formed so as to surround the core 126. Each of the first outer body 121, the second outer body 125, and the core 126 is composed of a high magnetic permeability material. The intermediate body 123 is composed of a low magnetic permeability material. Accordingly, in the layered inductor 120, a part of the magnetic path is an open magnetic circuit as shown by a dashed line in FIG. 31. As a result, the magnetic flux density hardly becomes excessive, the magnetic saturation therefore scarcely occurs. Consequently, the layered inductor 120 which is compact and shows excellent superimposed DC current characteristic is provided (refer to, for example, a Patent Document 1).

PRIOR ART DOCUMENT

Patent Document

[Patent Document 1] Japanese Unexamined Patent Application Publication No. 2001-267129).

SUMMARY OF THE INVENTION

However, manufacturing processes for the layered inductor 120 disclosed in the above Patent Document 1 are complicated and the manufacturing cost is therefore high, because the resin layer 122, the intermediate body 123, the resin layer 124, and the second outer body 125 must be layered on the first outer body 121, and subsequently, the core 126 must be formed. Further, since the part of the magnetic path is the open magnetic circuit, it is necessary to increase the number of turns of the coil conductor 127 in order to increase the inductance, and consequently, it has the problem of growing in size.

The present invention provides a compact inductor which can solve the problems described above and a method for manufacturing the same. The compact inductor according to the present invention comprises a coil, and a coil-burying body, and a body for constituting a closed magnetic circuit.

The coil is made of a conductor which is helically wound. In the present application, "a conductor which is helically wound" is not limited to a conductor whose cross sectional shape obtained by cutting by a plane perpendicular to a direction in which the coil extends (i.e., an axis direction of the coil) is circular, but may include a conductor whose cross sectional shape which is oval, square, and rectangular, etc. in other words, the outer shape of the helically wound conductor is not limited to a cylindrical column, but may be a rectangular parallelepiped, and a truncated cone, and so on. The helically wound coil may mean a spiral coil.

The coil-burying body is a fired ceramic body having a first magnetic permeability. The coil is buried in the coil-burying body. In the coil-burying body, "a through-hole passing through inside of the coil along an axis of the coil" is formed.

The body for a closed magnetic circuit is a fired ceramic body (an integrated/united fired body by firing) having a second magnetic permeability greater than the first magnetic permeability. The body for a closed magnetic circuit is arranged closely/densely with an outer circumference portion of the coil-burying body and within the through-hole, so that the coil-burying body is buried in "the body for a closed magnetic circuit" (i.e., the body for a closed magnetic, circuit houses/stores/holds the coil inside). Accordingly, the body for a closed magnetic circuit is formed so as to provide "a closed magnetic circuit which has no cut section" for the coil.

By means of the described structure, "the fired ceramic body having the first magnetic permeability (a portion including the coil-burying body and excluding the coil)" is arranged adjacent to (in close vicinity of) the coil, and "the fired ceramic body (the body for a closed magnetic circuit) having the second magnetic permeability larger than the first magnetic permeability" is arranged outside of the fired ceramic body having the first magnetic permeability. Accordingly, an intensity of magnetic field (magnetic flux density) generated in vicinity of the coil is relatively reduced compared to the conventional layered inductor, and magnetic saturation therefore hardly occurs. As a result, the compact inductor having an excellent superimposed DC current characteristic is provided.

Further, the magnetic path for the coil (or for a magnetic field generated by the coil when energized) passes through mainly in "the body for a closed magnetic circuit having the second magnetic permeability". Meanwhile, the body for a closed magnetic circuit is a fired united ceramic body. Accordingly, the magnetic path passing through "the body for a closed magnetic circuit" is a closed magnetic circuit (a closed magnetic circuit without a cut portion) which does not include a low magnetic permeability portion, such as a gap. It is therefore possible to increase the inductance of the coil without increasing the number of turns of the coil. In this manner, the present invention can provide a compact inductor which can meets the requirements described above.

In this case, it is preferable that the coil-burying body be made of a porous ceramic body. This allows the coil-burying body having a magnetic permeability (the first magnetic permeability) smaller than the magnetic permeability (the second magnetic permeability) of the body for a closed magnetic circuit to be easily provided. It should be noted that "the body for a closed magnetic circuit" may be a dense ceramic body or a porous ceramic body whose porosity (rate of pores present) is lower than that of the coil-burying body.

Further, in the compact inductor according to the present invention, it is preferable that a ratio ($\mu1/\mu2$) of the first magnetic permeability ($\mu1$) to the second magnetic permeability ($\mu2$) be equal to or greater than 0.19 and be smaller than or equal to 0.75.

According to experiments, the compact inductor having an excellent superimposed DC current characteristic was able to be obtained, when the first magnetic permeability ($\mu1$) and the second magnetic permeability ($\mu2$) were adjusted in such a manner that the ratio ($\mu1/\mu2$) was equal to or greater than 0.19 and was smaller than or equal to 0.75.

Furthermore, in the compact inductor according to the present invention, it is preferable that, both of the coil-burying body and the body for a closed magnetic circuit be made of porous ceramic bodies, in which the same kind of powders having the same diameter are dispersed, and a ratio ($\rho1/\rho2$) of a relative density ($\rho1$) of the coil-burying body to a relative density ($\rho2$) of the body for a closed magnetic circuit be equal to or greater than 0.73 and be smaller than or equal to 0.92, wherein the relative density is defined as a ratio of an actual density to a theoretical density.

According to experiments, the compact inductor having an excellent superimposed DC current characteristic was able to be obtained, when the ratio ($\rho1/\rho2$) was equal to or greater than 0.73 and was smaller than or equal to 0.92.

Furthermore, in the compact inductor according to the present invention, it is preferable that, a distance between an outer circumference of the coil and an outer circumference of the coil-burying body be the same as a distance between an inner circumference of the coil and an inner circumference of the coil-burying body; and a thickness (t) of the coil-burying body (which is equal to the distance) be equal to or greater than 30 μm and be smaller than or equal to 100 μm (refer to FIGS. 6 and 8).

According to experiments, cracks occurred in vicinity of the coil, when the thickness (t) was smaller than 30 μm. In addition, the inductance reduced greatly, when the thickness (t) was greater than 100 μm.

One of the methods (a first manufacturing method) for manufacturing the compact inductor described above according to the present invention comprises/includes the steps of:

(A) a coil forming/fabricating step;

(B) a coil-burying-body-before-fired forming step for forming a coil-burying-body-before-fired (coil-burying-body which has not been fired);

(C) an inductor-before-fired forming step for forming an inductor-before-fired (inductor which has not been fired); and (D) a firing step for firing the inductor-before-fired.

(A) The coil forming step is a process to form/fabricate the coil made of a helically wound conductor by winding a conductive wire helically.

(B) The coil-burying-body-before-fired forming step is a process to form the coil-burying-body-before-fired and includes the following steps.

(B1) A step (a first mold preparing step) of preparing a first mold having a concave portion for holding/storing/housing the coil and a columnar portion, the columnar portion being vertically arranged in the concave portion and having a shape which allows the columnar portion to pass through an inner side of the coil to form a through-hole. The concave portion for holding the coil is a space larger than a shape of the coil (a shape defined by an outer circumference of the coil). The columnar portion has a shape which can pass through a region including the axis of the coil (the inner side of the coil) without contacting with the coil.

(B2) A step (a coil placing/disposing step) of placing the coil within the first mold in such a manner that the columnar portion passes through the inner side of the coil. The coil is stored completely in the first mold without contacting the first mold.

(B3) A step (a first cast molding step) of filling the first mold with a ceramic slurry (a first ceramic slurry) containing first magnetic powders and having "a heat-gelling characteristic or a thermoset characteristic," the first ceramic slurry being adjusted in such a manner that a magnetic permeability of a body obtained by firing the first ceramic slurry becomes equal to the first magnetic permeability.

(B4) A step (a first hardening step) of forming the coil-burying-body-before-fired in which the coil is buried and which has a through-hole formed by the columnar portion at the inner side of the coil, by changing the first ceramic slurry poured into the first mold in such a manner that the first ceramic slurry keeps its shape by itself (i.e., the first ceramic slurry gelates or is hardened by heat).

(C) The inductor-before-fired forming step is a process to form the inductor-before-fired and includes the following steps.

(C1) A step (a second mold preparing step) of preparing a second mold having a space for holding/storing/housing the coil-burying-body-before-fired. The space for holding the coil-burying-body-before-fired is a space larger than a shape defined by an outer circumference of the coil-burying-body-before-fired.

(C2) A step (a coil-burying-body-before-fired placing/disposing step) of placing the coil-burying-body-before-fired within the second mold. At this step, the coil-burying-body-before-fired is held in the second mold in such a manner that the coil-burying-body-before-fired does not contact with the second mold. The coil-burying-body-before-fired is stored completely in the second mold without contacting the second mold.

(C3) A step (a second cast molding step) of filling the second mold with a second ceramic slurry containing a second magnetic powders and having "a heat-gelling characteristic or a thermoset characteristic", the second ceramic slurry being adjusted in such a manner that a magnetic permeability of a body obtained by firing the second ceramic slurry becomes the second magnetic permeability greater than the first magnetic permeability, so that the second ceramic slurry exists densely at an outer circumference portion of the coil-burying-body-before-fired and within the through-hole.

(C4) A step (a second hardening step) of changing the second ceramic slurry poured into the second mold in such a manner that the second ceramic slurry keeps its shape by itself (i.e., the second ceramic slurry gelates or is hardened by heat).

Generally, in this kind of a compact inductor, the coil is formed by firing/sintering a paste-like metal (e.g., silver) formed on a ceramic green sheet by printing etc. That is, the coil is made of the sintered metal. However, the sintered metal inevitably contains impurities (such as a flux) or pores, the resistance of the sintered metal is therefore large. To the contrary, according to the present manufacturing method described above, the coil can be made of a normal (pure) metal (e.g., dense pure metal), instead of the sintered metal. Accordingly, the resistance of the compact inductor can be made smaller.

Further, when "a rigid coil which hardly deforms" is buried in a typical ceramic slurry, and thereafter the ceramic slurry is dried to fabricate "a coil-burying-body-before-fired (a structural body which will become the coil-burying-body by firing", cracks occurs in the coil-burying-body-before-fired. The cracks are generated due to shrinkage of the coil-burying-body-before-fired when a solvent evaporates while the coil-burying-body-before-fired is being dried.

To the contrary, in the described step of forming the coil-burying-body-before-fired, "the coil-burying-body-before-fired" is formed using the ceramic slurry having "the heat-gelling characteristic or a thermoset characteristic". In other words, "the coil-burying-body-before-fired" is fabricated according to gelcast forming. In the gelcast forming, a structural body made of the slurry changes into a body which can keep its shape by itself (i.e., is hardened) by a chemical reaction, and thereafter, the solvent evaporates. Accordingly, the structural body hardly shrinks. As a result, "the coil-burying-body-before-fired" having no crack is formed extremely easily.

Furthermore, in the described inductor-before-fired forming step, "the body for a closed magnetic circuit before fired (a structural body which has not been fired and will become the body for a closed magnetic circuit) is formed according to the gelcast forming. Accordingly, no crack occurs in the body for a closed magnetic circuit before fired. Thereafter, the inductor-before-fired comprising the coil-burying-body-before-fired and the-body-for-a-closed-magnetic-circuit-before-fired is fired in the firing step. Consequently, a body for a closed magnetic circuit can easily be manufactured, the body for a closed magnetic circuit having the second magnetic permeability "at a portion outside of the coil-burying-body and within the through-hole". That is, "the compact inductor of the present invention" having the structure described above can easily be manufactured according to the first manufacturing method.

In the present manufacturing method for manufacturing the compact inductor, it is preferable that the first ceramic slurry contains a pore-forming agent which functions so as to change a portion obtained by firing the first ceramic slurry in the firing step into a porous body.

For example, the pore-forming agent may be fine grains which disappear in the firing process (for example, fine acrylic grains, etc.).

According to the method, a great number of pores (holes) are formed in the coil-burying-body (the portion obtained by firing the first ceramic slurry in the firing process), and it is therefore possible to easily form the coil-burying-body having the low magnetic permeability (the first magnetic permeability smaller than the second magnetic permeability).

Further, in the present manufacturing method for manufacturing the compact inductor, it is preferable that, the first ceramic slurry contains, as the first magnetic powders, magnetic powders whose median diameter is adjusted to be equal to a first grain diameter in such a manner that a portion obtained by firing the first ceramic slurry in the firing step changes into a porous body, and the second ceramic slurry contains, as the second magnetic powders, magnetic powders whose median diameter is adjusted to be equal to a second grain diameter smaller than the first grain diameter in such a manner that a portion obtained by firing the second ceramic slurry in the firing step changes into a dense body (a body denser than a portion obtained by firing the first ceramic slurry in the firing step).

According to this, "the magnetic powders (the first magnetic powders) whose median diameter is relatively large" is mixed into the first ceramic slurry, a great number of holes are therefore formed in the coil-burying-body (a portion obtained by firing the first ceramic slurry in the firing step). As a result, the coil-burying-body having the low magnetic permeability (the first magnetic permeability smaller than the second magnetic permeability) can easily be manufactured.

Meanwhile, "the magnetic powders (the second magnetic powders) whose median diameter is relatively small" is mixed into the second ceramic slurry, the body for a closed magnetic circuit (a portion obtained by firing the second ceramic slurry in the firing step) becomes a relatively denser fired ceramic body (whose porosity is smaller than that of the coil-burying-body). As a result, the body for a closed magnetic circuit having the high magnetic permeability (the second magnetic permeability greater than the first magnetic permeability) can easily be manufactured.

Another one of the methods (a second manufacturing method) for manufacturing the compact inductor according to the present invention includes the steps of:

(E) a coil-burying-body-before-fired forming step;

(F) an inductor-before-fired forming step; and (G) a firing step for firing the inductor-before-fired.

(E) The coil-burying-body-before-fired forming step is a process to form the coil-burying-body-before-fired and includes the following steps.

(E1) A step (a ceramic green sheets preparing step) of preparing a plurality of ceramic green sheets adjusted in such a manner that a magnetic permeability of a body obtained by firing the ceramic green sheets becomes equal to a first magnetic permeability.

(E2) A step (a thin conductive film forming step) of forming thin conductive films on each of the ceramic green sheets in such a manner that each of the thin conductive films has a predetermined pattern which surrounds a predetermined area on each of the ceramic green sheets.

(E3) A step (a coil forming step) of forming "a coil made of a helically wound conductor" by layering the plurality of ceramic green sheets (performing a layering step), and electrically connecting the thin conductive films formed on any two of the ceramic green sheets adjacent to each other in a direction of layering with each other "through via holes (using a conductor in the via holes)".

(E4) A step (a through-hole forming step) of forming a through-hole at the predetermined area. This through-hole forming step may be a step for forming a through-hole in the ceramic green sheets layered in the layering step by a punching process and soon, or be a step for forming a through-hole passing through each of the ceramic green sheets by a punching process and so on before the layering step.

The step of forming the coil-burying-body-before-fired is a step similar to a step included a conventional manufacturing method for "the layered inductor". Accordingly, "the coil-burying-body-before-fired" can easily be manufactured with using ceramic green sheets.

(F) The inductor-before-fired forming step is a process to form inductor-before-fired and includes steps as follows. The inductor-before-fired forming step includes steps which is substantially the same as the inductor-before-fired forming step (C) in the first manufacturing method described above.

(F1) A step (a mold preparing step) of preparing a mold having a space for holding/storing/housing the coil-burying-body-before-fired. The space for holding the coil-burying-body-before-fired of the mold is a space larger than a shape defined by an outer circumference of the coil-burying-body-before-fired.

(F2) A step (a coil-burying-body-before-fired placing/disposing step) of placing the coil-burying-body-before-fired within the mold. At this step, the coil-burying-body-before-fired is held in the mold in such a manner that the coil-burying-body-before-fired does not contact with the mold. The coil-burying-body-before-fired is stored completely in the mold.

(F3) A step (a cast molding step) of filling the mold with a ceramic slurry (which is the same as the second ceramic slurry described above) containing magnetic powders and having "a heat-gelling characteristic or a thermoset characteristic", the ceramic slurry being adjusted in such a manner that a magnetic permeability of a body obtained by firing the ceramic slurry becomes the second magnetic permeability greater than the first magnetic permeability, so that the ceramic slurry exists densely at an outer circumference portion of the coil-burying-body-before-fired and within the through-hole.

(F4) A step (a hardening step) of changing the second ceramic slurry poured into the mold in such a manner that the ceramic slurry keeps its shape by itself (i.e., the ceramic slurry gelates or is hardened by heat).

According to the inductor-before-fired forming step, "the body for a closed magnetic circuit before fired (a structural body which has not been fired and will become the body for a closed magnetic circuit) is formed based on the gelcast forming. Accordingly, the body for a closed magnetic circuit before fired hardly shrinks when it is being dried. Consequently, no crack occurs in the body for a closed magnetic circuit before fired.

Further, in this step, "the inductor-before-fired" having the body for a closed magnetic circuit before fired which stores the coil-burying-body-before-fired is fabricated, and the inductor-before-fired is fired in the following firing step. Consequently, the body for a closed magnetic circuit can easily be manufactured, the body for a closed magnetic circuit having the second magnetic permeability "at a portion outside of the coil-burying-body and within the through-hole". That is, "the compact inductor of the present invention" having the structure described above can easily be manufactured according to the second manufacturing method as well.

DETAILED DESCRIPTION OF THE PRESENT INVENTION

Next will be described "compact inductors and methods for manufacturing the same" according to embodiments of the present invention with reference to the drawings.

Figure 1:
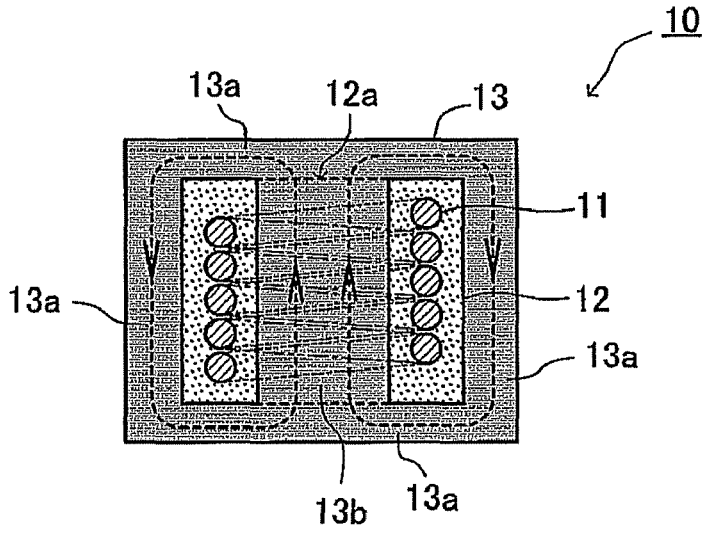
FIG. 1 is a vertical cross-sectional view of a compact inductor according to an embodiment of the present invention (cross-sectional view cut by a plane along an axis of the compact inductor)
Figure 2:
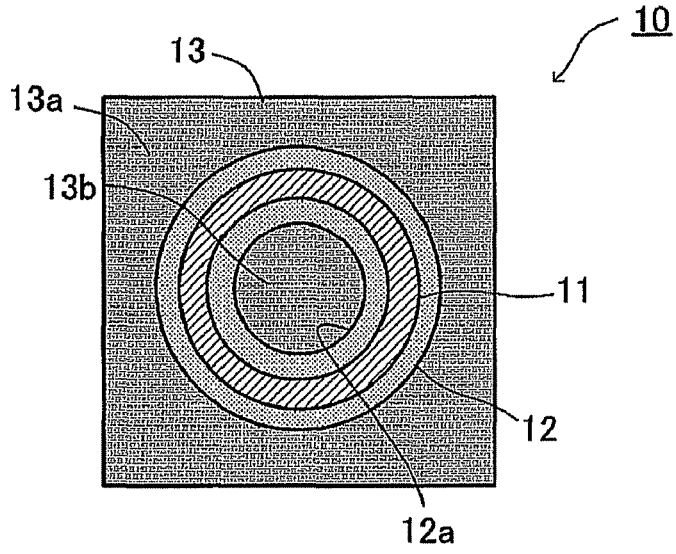
FIG. 2 is a horizontal cross-sectional view of the compact inductor shown in FIG. 1 (cross-sectional view cut by a plane perpendicular to the axis of the compact inductor)

FIG. 1 is a vertical cross-sectional view of "a compact inductor 10" according to an embodiment of the present invention. FIG. 2 is a horizontal cross-sectional view of the compact inductor 10. The compact inductor 10 comprises a coil 11, a coil-burying body 12, and a body for a closed magnetic circuit 13.

The coil 11 is composed of a helically wound conductor. Accordingly, the coil 11 has a substantially cylindrical shape. In the present example, the coil 11 is made of a silver (Ag) wire, whose cross-sectional view has a circular shape having 0.1 mm in diameter ($\phi$0.1 mm). That is, coil 11 may be made of a dense metal. The coil 11 is formed in such a manner that the wire is wound 5 turns around a center axis. A surface of the coil 11 is covered with a film composed of a resin in which ferrite powders are dispersed. A thickness of the film is 10 $\mu$m.

It should be noted that the cross sectional shape of the above Ag wire is not limited to the circular shape, but may be oval, square, rectangular, and so on. Especially, it is preferable that, in a cross-sectional view of the conductor (Ag wire) cut (or taken) by a plane parallel to the center axis of the coil 11, a length in a direction of the center axis of the coil 11 be smaller than a length in a direction perpendicular to the center axis of the coil 11. This allows a distance between the conductors (i.e., a pitch) to be smaller, and it is therefore possible to wind the conductor with a high density. Consequently, this can provide an advantage that its inductance can become large with a smaller number of turns.

The coil-burying body 12 is a fired porous ceramic body having a first magnetic permeability. The coil-burying body 12 has a substantially cylindrical shape. An outer diameter of the coil-burying body 12 is larger than an outer diameter of the coil 11. In the coil-burying body 12, the coil 11 is arranged coaxially with the coil-burying body 12. "A through-hole 12*a* having a cylindrical shape" is formed so as to be coaxial with the coil-burying body 12 (and the coil 11) at a central portion of the coil-burying body 12. A diameter of the through-hole 12*a* is smaller than an inner diameter of the coil 11. As just described, the coil-burying body 12 is the fired ceramic body in which the coil 11 is buried and has the through-hole 12*a* passing through the inside of the coil 11 along the axis (center axis) of the coil 11.

The body for a closed magnetic circuit 13 is a fired dense ceramic body having a second magnetic permeability larger than the first magnetic permeability (i.e., the body 13 is denser than the coil-burying body 12, and has a porosity smaller than the porosity of the coil-burying body 12). The body for a closed magnetic circuit 13 has a substantially rectangular parallelepiped shape. A shape of the body for a closed magnetic circuit 13 in plan view is substantially square. A length of each of sides of the square is larger than the outer diameter of the coil-burying body 12. It should be noted that the body for a closed magnetic circuit 13 may have a substantially cylindrical shape. In this case, an outer diameter of the body for a closed magnetic circuit 13 is larger than the outer diameter of the coil-burying body 12. A space having the same shape as the coil-burying body 12 is formed at a central portion of the body for a closed magnetic circuit 13. The coil-burying body 12 is placed (buried) in the space. In other words, the coil-burying body 12 is arranged in the body for a closed magnetic circuit 13 so as to be coaxial with the body for a closed magnetic circuit 13.

As just described, the body for a closed magnetic circuit 13 is "the fired ceramic body, in which the coil-burying body 12 is buried", having a portion 13*a* and a portion 13*b*, the portion 13*a* being a portion which is densely/closely arranged with an outer circumference portion of the coil-burying body 12 (i.e., at an outside portion adjacent to the side surface of the coil-burying body 12, an outside portion adjacent to the upper surface of the coil-burying body 12, and an outside portion adjacent to the lower surface of the coil-burying body 12), and the portion 13*b* being a portion which is densely/closely arranged within the through-hole 12*a* of the coil-burying body 12.

In the compact inductor 10, the magnetic permeability of the body for a closed magnetic circuit 13 (the second magnetic permeability) is greater than the magnetic permeability of the coil-burying body 12 (the first magnetic permeability). Accordingly, as shown by a dashed line in FIG. 1, most of the magnetic flux generated when the coil 11 is energized and passes through the inside of the body for a closed magnetic circuit 13. In this manner, the body for a closed magnetic circuit 13 provides "a closed magnetic circuit having no low magnetic permeability portion such as a gap or a hollow (i.e., a closed magnetic circuit having no cut section)" for the coil 11.

As described above, in the compact inductor 10, "the fired ceramic body having the first magnetic permeability (a portion including the coil-burying body 12 and excluding the coil 11)" is arranged in close vicinity of the coil 11, and "the fired ceramic body (the body for a closed magnetic circuit) 13 having the second magnetic permeability larger than the first magnetic permeability is arranged outside of the fired ceramic body having the first magnetic permeability. Accordingly, when a current is flowed in the coil 11, an intensity of magnetic field (magnetic flux density) generated in vicinity of the coil 11 is relatively reduced, and thus, magnetic saturation hardly occurs. As a result, the compact inductor 10 is an inductor having an excellent superimposed DC current characteristic.

Further, the magnetic path for the coil 11 is formed in the body for a closed magnetic circuit 13 which is "the fired dense ceramic body, integrated by firing and having the second magnetic permeability." Accordingly, the magnetic path is a closed magnetic circuit which does not pass through a low magnetic permeability portion such as a gap. Consequently, it is possible to increase the inductance of the coil 11 without increasing the number of turns of the coil 11.

As a result, the compact inductor 10 is an inductor, which is compact, has a large inductance, and shows an excellent superimposed DC current characteristic, since magnetic saturation hardly occurs. Moreover, the coil 11 is composed of a normal metal (the dense pure metal, silver in the present example), instead of "a sintered metal." Accordingly, the compact inductor 11 has an extremely low resistance.

<A First Manufacturing Method>

Next will be described "a method for manufacturing the compact inductor inductors 10 (hereinafter, referred to as "a first manufacturing method")" according to a first embodiment of the present invention. The first manufacturing method including:

(A) A coil forming process/step for forming (fabricating/making) a coil composed of a conductor which is helically wound;

(B) A coil-burying-body-before-fired forming process/step for forming (fabricating/making) a coil-burying-body-before-fired;

(C) An inductor-before-fired forming process/step for forming (fabricating/making) an inductor-before-fired; and (D) A firing process/step for firing the inductor-before-fired. Each of the processes will be described hereinafter.

Figure 3:
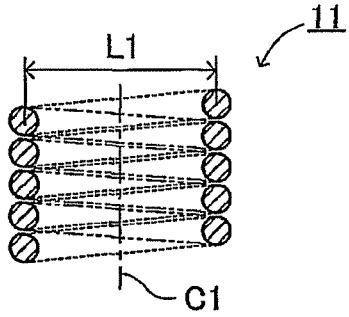
FIG. 3 is a cross-sectional view of a coil shown in FIG. 1.

(A) The Coil Forming Process:

A silver (Ag) wire is prepared, whose cross sectional shape has a circular shape having a 0.1 μm in diameter (ϕ0.1 mm). Subsequently, the silver wire is coated by a film (10 μm in thickness) composed of a resin (dispersed resin) in which ferrite powders are dispersed. The resin contained in the dispersed resin is polyester. A grain diameter of the ferrite grain/powder contained in the dispersed resin is 0.5 μm. The ferrite grains/powders are added to the dispersed resin in such a manner that a volume ratio of the ferrite powders becomes equal to 40%. Subsequently, as shown in FIG. 3, the silver wire is wound 5 turns around the center axis C1 to fabricate the coil 11. A diameter of the coil (coil diameter) L1 is 1.4 mm. It should be noted that the diameter of the silver wire, a number of turns and a diameter of the coil 11, and the component of the resin in which the ferrite powders are dispersed, and so on, may be modified and adjusted, appropriately.

(B) The Coil-burying-body-before-fired Forming Process:

The coil-burying-body-before-fired forming process includes:

(B1) a first mold preparing process;

(B2) a coil placing process;

(B3) a first cast molding process; and (B4) a first hardening process.

Figure 4:
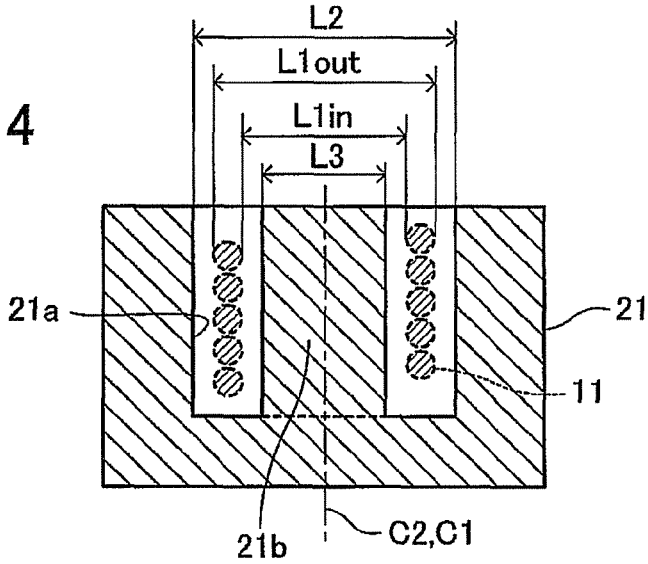
FIG. 4 is a vertical cross-sectional view of a first mold used in a first method for manufacturing (a first manufacturing method) according to the present invention.

(B1) The First Mold Preparing Process:

First, a first mold 21 shown in FIG. 4 is prepared. An outer shape of the first mold 21 is substantially cylindrical. The first mold 21 comprises a cylindrical concave portion 21*a* for holding/storing the coil 11 and a columnar portion 21*b* which is cylindrical. The columnar portion 21*b* is vertically arranged (or is installed in a standing manner) on the bottom surface of the concave portion 21*a* in the concave portion 21*a* in such a manner that the columnar portion 21*b* is coaxial with the concave portion 21*a*.

A diameter L2 of the concave portion 21*a* is larger than an outer diameter L1 out of the coil 11. A depth of the concave portion 21*a* is greater than a height of the coil 11. That is, the concave portion 21*a* is a space larger than the shape of the coil 11 (a shape defined by an outer circumference of the coil 11) so that the concave portion 21*a* can hold/store the coil 11. A diameter L3 of the columnar portion 21*b* is smaller than an inner diameter L1 in of the coil 11. A height of the columnar portion 21*b* is higher than a height of the coil 11. Accordingly, the columnar portion 21*b* has a shape which can pass through (penetrate) an inner side of the coil 11 (an inner circumference side, a space including the center axis C1).

Figure 5:
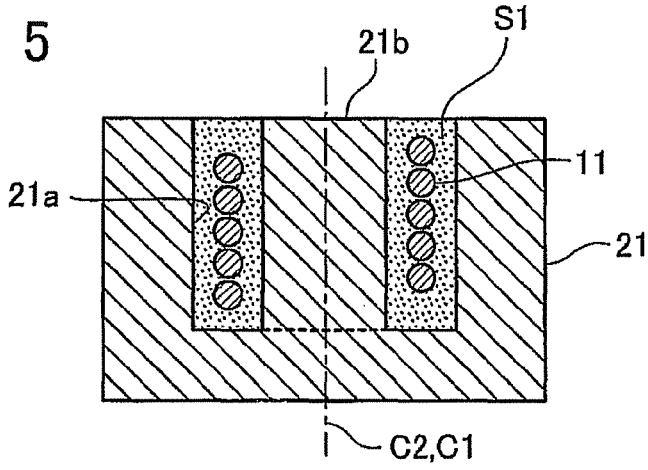
FIG. 5 depicts a coil-burying-body-before-fired forming process in the first manufacturing method.

(B2) The Coil Placing Process:

As shown in FIG. 5, the coil placing process is a process in which the coil 11 is placed within the first mold 21 (the concave portion 21*a*) in such a manner that the columnar portion 21*b* passes through the inside of the coil 11. At this time, the coil is arranged so as to be coaxial with the concave portion 21*a*. That is, the coil 11 is stored in the first mold 21 in such a manner that the center axis C1 of the coil 11 is on a center axis C2 of the concave portion 21*a* and the columnar portion 21*b*. At this time, the coil 11 is held or supported in such a manner that the coil 11 is apart, by a predetermined distance, from wall surfaces (a side wall surface and a bottom wall surface) of the concave portion 21*a* and an outer surface of the columnar portion 21*b*. In addition, the coil 11 is arranged/stored so as to be completely inside of the concave portion 21*a*.

(B3) The First Cast Molding Process:

First, a first ceramic slurry S1 is prepared. The first ceramic slurry S1 is a ceramic slurry, which contains first magnetic powders and has "a heat-gelling characteristic or a thermoset characteristic", and which is adjusted in such a manner that "a magnetic permeability of a body obtained by drying and firing the first ceramic slurry S1 becomes equal to the first magnetic permeability."

In the present example, the first ceramic slurry S1 is prepared as follows.

Ferrite powders are prepared as first magnetic powders. For the ferrite powders, Ni—Cu—Zn ferrite powders, supplied by Japan Metals & Chemicals Co., Ltd. (Part Number JR21 (0.8 μm in median diameter) or Part Number JR07 (0.8 μm in median diameter)), whose median diameter is adjusted so as to be 0.5 μm are used.

A pore-forming agent is prepared. For the pore-forming agent, fine acrylic grains, supplied by Soken Chemical & Engineering Co., Ltd. (Part Number MX-150, 1.5 μm in grain diameter) is used. The pore-forming agent disappears in the firing process (D) performed later.

Subsequently, the ferrite powders and the pore-forming agent are put into a ball mill in such a manner that a volume fraction of the ferrite powders is 25% and a volume fraction of the pore-forming agent is 20%, together with zirconia balls, a solvent, and a dispersion media, to be mixed. At this time, the ball mill is rotated at 80 rpm for 24 hours.

The solvent and the dispersion media are as follows.

The Solvent:

The solvent is a mixture of triacetin and glutaric acid dimethyl. In the mixture, ratio by weight of the triacetin to the glutaric acid dimethyl is 1:9.

The Dispersion Media:

The dispersion media contains 4.3 parts by weight of MALIALIM (Trade name) per 100 parts by weight of the solvent.

A resin, a hardening agent, and a catalyst, described below, are added to the resultant slurry obtained by the mixture by the ball milling.

The Resin:

6.5 parts by weight of 4, 4'-diphenylmethane diisocyanate per 100 parts by weight of the solvent.

The Hardening Agent:

0.38 parts by weight of ethylene glycol per 100 parts by weight of the solvent.

The Catalyst:

0.05 parts by weight of 6-Dimethylamino-1-hexanol per 100 parts by weight of the solvent.

As a result, the first ceramic slurry S1 is prepared, the slurry S1 containing the first magnetic powders, having "a heat-gelling characteristic or a thermoset characteristic (in the present example, the thermoset characteristic)", and being adjusted in such a manner that a magnetic permeability of a body obtained by firing the first ceramic slurry S1 becomes equal to the first magnetic permeability.

Subsequently, as shown in FIG. 5, the first ceramic slurry S1 is put/poured into the first mold 21 (the concave portion 21*a*). It should be noted that a mold release agent is applied to surfaces of the concave portion 21*a* and the columnar portion 21*b* of the first mold 21 in advance. This is the first cast molding process.

(B4) The First Hardening Process:

Thereafter, the first ceramic slurry S1 is held/kept in the first mold 21 for 24 hours. During this period, the first ceramic slurry S1 gelates. Subsequently, the ceramic slurry S1 which has gelated is dried by leaving the slurry S1 in a temperature of 130° C. for 4 hours. As a result, a hardened body made of the hardened gel is formed. After that, the hardened body is taken out from the first mold 21 (the mold is released). That is, the first hardening process is a process in which the first ceramic slurry S1 poured into the first mold 21 is changed so that the slurry S1 can keep its shape (i.e., the slurry S1 gelates or is hardened by heat).

Figure 6:
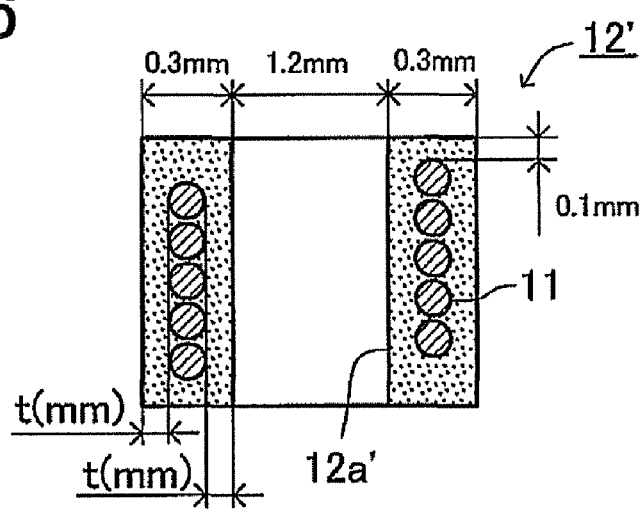
FIG. 6 is a vertical cross-sectional view of the coil-burying-body-before-fired formed at a middle/intermediate stage of the first manufacturing method.

As a result, "a coil-burying-body-before-fired 12' (a body which will be the coil-burying body 12 by subsequent firing)" is formed, as shown in FIG. 6. The coil-burying-body-before-fired 12' includes the coil 11 buried inside and a through-hole 12*a*' (a hole which will be the through-hole 12*a* after firing). It should be noted that dimensions of portions of the coil-burying-body-before-fired 12' according to the present example are shown in FIG. 6.

(C) The Inductor-before-fired Forming Process:

The inductor-before-fired forming process includes, (C1) a second mold preparing process;

(C2) a coil-burying-body-before-fired placing process;

(C3) a second cast molding process; and (C4) a second hardening process.

Figure 7:
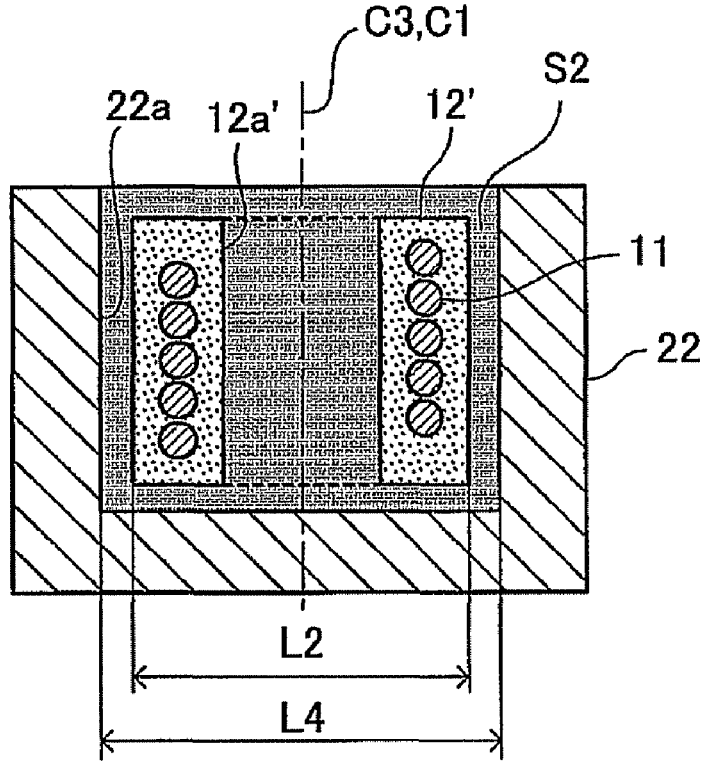
FIG. 7 is a view including a vertical cross-sectional view of a second mold used in the first manufacturing method.

(C1) The Second Mold Preparing Process:

A second mold 22 shown in FIG. 7 is prepared. The second mold 22 has a concave portion 22*a* (a space 22*a*) for holding/storing the coil-burying-body-before-fired 12'. A shape of the concave portion 22*a* is substantially rectangular parallelepiped. A shape of a bottom surface of the concave portion 22*a* is substantially square.

A length L4 of each side of the bottom surface of the concave portion 22*a* is larger than an outer diameter L2 of the coil-burying-body-before-fired 12'. A depth of the concave portion 22*a* is greater than a height of the coil-burying-body-before-fired 12'. That is, the space 22*a* for holding/storing the coil-burying-body-before-fired 12' is a space larger than a shape defined by an outer circumference of the coil-burying-body-before-fired 12'.

(C2) The Coil-burying-body-before-fired Placing Process:

As shown in FIG. 7, the coil-burying-body-before-fired placing process is a process in which the coil-burying-body-before-fired 12' is placed within the second mold 22 (the concave portion 22*a*). At this time, the coil-burying-body-before-fired 12' is arranged so as to be coaxial with the concave portion 22*a*. That is, the coil-burying-body-before-fired 12' is placed in the concave portion 22*a* in such a manner that the center axis C1 of the coil 11 and the coil-burying-body-before-fired 12' is on a center axis C3 of the concave portion 22*a*. Further, in this case, the coil-burying-body-before-fired 12' is held or supported in such a manner that the coil-burying-body-before-fired 12' is apart from, by a predetermined distance, from wall surfaces of the concave portion 22*a*. In addition, the coil-burying-body-before-fired 12' is arranged/stored to be completely inside of the concave portion 22*a*.

(C3) The Second Cast Molding Process:

First, a second ceramic slurry S2 is prepared. The second ceramic slurry S2 is a ceramic slurry, which contains second magnetic powders and has "a heat-gelling characteristic or a thermoset characteristic", and which is adjusted in such a manner that a magnetic permeability of a body obtained by drying and firing the second ceramic slurry S2 becomes equal to "the second magnetic permeability greater than the first magnetic permeability".

In the present example, the second ceramic slurry S2 is prepared as follows.

Ferrite powders are prepared as second magnetic powders. For the ferrite powders, Ni—Cu—Zn ferrite powders, supplied by Japan Metals & Chemicals Co., Ltd. (Part Number JR21 (0.8 μm in median diameter), or Part Number JR07 (0.8 μm in median diameter)), whose median diameter is adjusted so as to be 0.5 μm are used.

Subsequently, the ferrite powders are put/poured into a ball mill in such a manner that a volume fraction of the ferrite powders is 40% together with zirconia balls, a solvent, and a dispersion media, to be mixed. At this time, the ball mill is rotated at 80 rpm for 24 hours.

The solvent and the dispersion media are as follows.

The Solvent:

The solvent is a mixture of triacetin and glutaric acid dimethyl. In the mixture, ratio by weight of the triacetin to the glutaric acid dimethyl is 1:9.

The Dispersion Media:

The dispersion media contains 100 parts by weight of the solvent and 4.3 parts by weight of MALIALIM (Trade name).

A resin, a hardening agent, and a catalyst, described below, are added to the resultant slurry obtained by the mixture by the ball milling.

The Resin:

6.5 parts by weight of 4, 4'-diphenylmethane diisocyanate per 100 parts by weight of the solvent.

The Hardening Agent:

0.38 parts by weight of ethylene glycol per 100 parts by weight of the solvent.

The Catalyst:

0.05 parts by weight of 6-Dimethylamino-1-hexanol per 100 parts by weight of the solvent.

As a result, the second ceramic slurry S2 is prepared, the slurry S2 containing the second magnetic powders, having "a heat-gelling characteristic or a thermoset characteristic (in the present example, the thermoset characteristic)", and being adjusted in such a manner that a magnetic permeability of a body obtained by firing the second ceramic slurry S2 becomes equal to the second magnetic permeability.

Subsequently, as shown in FIG. 7, the second ceramic slurry S2 is put/poured into the second mold 22 (the concave portion 22*a*). It should be noted that a mold release agent is applied to surfaces of the concave portion 22*a* of the second mold 22 in advance. As a result, the second ceramic slurry S2 exists densely at an outer circumference portion of the coil-burying-body-before-fired 12' and within the through-hole 12*a*'. This is the second cast molding process.

(C4) The Second Hardening Process:

Thereafter, the second ceramic slurry S2 is held/kept in the second mold 22 for 24 hours. During this period, the second ceramic slurry S2 gelates. Subsequently, the ceramic slurry S2 which has gelated is dried by leaving the slurry S2 in a temperature of 130° C. for 4 hours. As a result, a hardened body made of the hardened gel is formed. After that, the hardened body is taken out from the second mold 22 (the mold is released). That is, the second hardening process is a process in which the second ceramic slurry S2 poured into the second mold 22 is changed so that the slurry S2 can keep its shape (i.e., the slurry S2 gelates or is hardened by heat).

Figure 8:
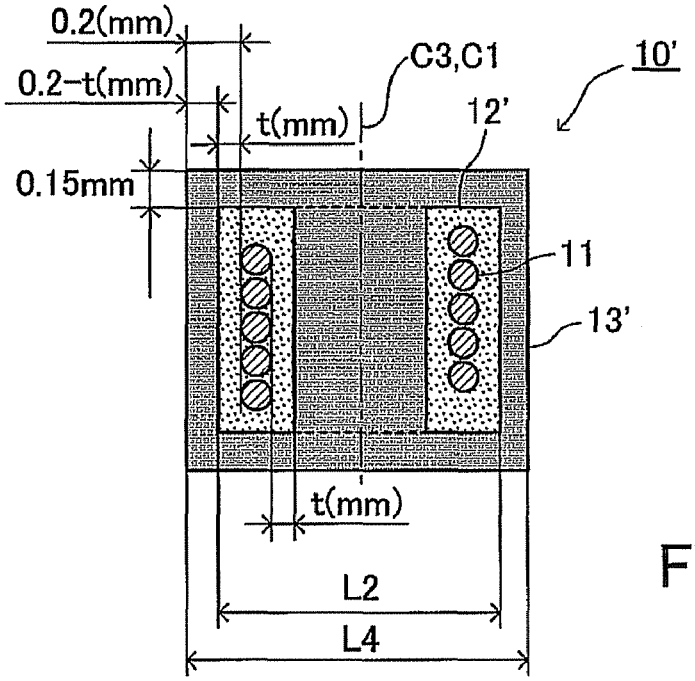
FIG. 8 is a vertical cross-sectional view of an inductor-before-fired formed at a middle/intermediate stage of the first manufacturing method.

As a result, an inductor-before-fired 10' including "a coil-burying-body-before-fired 12' in which the coil 11 is buried" and "a body for a closed magnetic circuit before fired 13' in which the coil-burying-body-before-fired 12' is buried" shown in FIG. 8 is formed. It should be noted that dimensions of portions of the body for a closed magnetic circuit before fired 13' according to the present example are shown in FIG. 8.

(D) The Firing Process for Firing the Inductor-before-fired:

Subsequently, the thus formed inductor-before-fired 10' is set/placed in a furnace. An environmental temperature (a furnace temperature) is increased up to 500° C. at a rate of temperature increase of 50° C./h, and then, the environmental temperature (the furnace temperature) is kept at 500° C. for 2 hours. As a result, a degreasing of the inductor-before-fired 10' is performed.

Subsequently, the environmental temperature (the furnace temperature) is increased rapidly up to 950° C. from 500° C. within 15 minutes. Then, the environmental temperature (the furnace temperature) is kept at 950° C. for 2 hours. As a result, the inductor-before-fired 10' is fired (burnt). That is, the coil-burying-body-before-fired 12' changes into a fired porous ceramic body having the first magnetic permeability, and the body for a closed magnetic circuit before fired 13' changes into a fired substantially dense ceramic body having the second magnetic permeability. Accordingly, the compact inductor 10 shown in FIGS. 1 and 2 is manufactured. Thereafter, connecting terminals etc. are formed. The connecting terminals are formed by, for example, plating the compact inductor 10 with an Ag paste with keeping a temperature of 600° C. for 30 minutes.

As described above, according to the first manufacturing method, "the coil-burying-body-before-fired 12'" is manufactured by a gelcast forming using the ceramic slurry having "the heat-gelling characteristic or the thermoset characteristic". In the gelcast forming, the structure/body which has not been dried is hard to shrink when it is being dried. Accordingly, it is possible to easily manufacture/fabricate the coil-burying-body-before-fired 12' containing the coil 11, which is a rigid body, while avoiding an occurrence of cracks, without failure.

Further, according to the first manufacturing method, the inductor 10, wherein a body having a relatively low magnetic permeability (the coil-burying body 12 having the first magnetic permeability) exists adjacent to the coil 11, and a body having a relatively high magnetic permeability (the body for a closed magnetic circuit 13 having the second magnetic permeability) exists so as to surround the body having a relatively low magnetic permeability, is manufactured/provided by a single firing process. Accordingly, the high performance compact inductor 10 can be manufactured by simple manufacturing processes.

Further, the first ceramic slurry S1 contains "the pore-forming agent which changes a portion obtained by firing the first ceramic slurry S1 in the firing process into a porous body". Accordingly, since the coil-burying body 12 becomes the porous body, the magnetic permeability of the coil-burying body 12 can easily be made smaller than the magnetic permeability of the body for a closed magnetic circuit 13.

It should be noted that, the first ceramic slurry S1 may include/contain, as the first ferrite powders, the magnetic powders (ferrite grains) whose median diameter is adjusted/controlled to be equal to the first grain diameter in such a manner that the portion obtained by firing the first ceramic slurry S1 in the firing process becomes the porous body, and the second ceramic slurry S2 may include/contain, as the second ferrite powders, the magnetic powders (ferrite grains) whose median diameter is adjusted/controlled to be equal to the second grain diameter smaller than the first grain diameter in such a manner that the portion obtained by firing the second ceramic slurry S2 in the firing process becomes the dense body (i.e., the substantially dense body whose porosity is smaller than that of the portion obtained by firing the first ceramic slurry S1 in the firing process).

This also allows the coil-burying body 12 to become the porous body which has a relatively high porosity, the magnetic permeability of the coil-burying body 12 can therefore easily be made smaller than the magnetic permeability of the body for a closed magnetic circuit 13.

Further, magnetic powders whose median diameter is smaller than the median diameter contained in the second ceramic slurry S2 may be added to the first ceramic slurry S1, and the above described pore-forming agent may be added to the first ceramic slurry S1.

Furthermore, in the first manufacturing process, the furnace temperature is increased rapidly up to 950° C. from 500° C. within a short period of time (which is 15 minutes with the rate of temperature increase=450° C./15 minutes). By this kind of control of the firing temperature, it is possible to avoid occurrence of cracks around the coil in the coil-burying body 12 with more certainty. The reasons for this will be described below.

Generally, when firing of ceramic is performed, the furnace temperature is increased gradually from a degreasing temperature of 500° C. to a firing temperature of 900° C. for 5 hours or so. During this period, sintering starts and proceeds gradually from a timing at which the furnace temperature reaches, for example, 700° C. Meanwhile, the coil 11 is made of a conductive metal, such as silver, and thus, the melting point of the coil 11 is higher than 900° C. (e.g., 960° C. when silver is used). Accordingly, when the ceramic is fired according to the conventional method, the coil 11 which is a rigid body inhibits/obstructs shrinkage of the ceramic due to firing (sintering). As a result, cracks occur in the ceramic at an early stage after the ceramic starts to be fired/sintered.

To the contrary, if the temperature is controlled according to the first manufacturing method (i.e., the furnace temperature is increased extremely rapidly), a temperature of the coil 11 reaches a temperature close to the melting point of silver when the ceramic starts to be fired/sintered, and thus, a hardness of the coil 11 is reduced. As a result, a large stress is not applied to the ceramic after the ceramic starts to be fired/sintered. Accordingly, no crack occurs in the ceramic.

As described above, the firing process of the first manufacturing method can be said to be "a process for controlling a temperature of the inductor-before-fired 10 (i.e., a controlling process to rapidly increase the temperature of the coil 11 up to the firing temperature of the inductor-before-fired 10') in such a manner that a temperature of the coil 11 reaches a temperature near the melting point of a metal constituting the coil 11 at the timing of or by the timing immediately after starting the firing (densification) of the inductor-before-fired 10' (especially the coil-burying-body-before-fired 12')".

It should be noted that a filling rate of the ceramic powders of the first slurry S1 may be increased between around 32% volume fraction and around 54% volume fraction, in order to enhance the break strength of the inductor-before-fired 10' (especially the coil-burying-body-before-fired 12') at the start of firing (densification) of the inductor-before-fired 10' (especially the coil-burying-body-before-fired 12').

Table 1 and Table 2 show evaluation results of the compact inductors manufactured according to the first manufacturing method, while varying the magnetic permeability of the coil-burying body 12 (the first magnetic permeability), the magnetic permeability of the body for a closed magnetic circuit 13 (the second magnetic permeability), and the thickness t of the coil-burying body 12.

These compact inductors were manufactured in such a manner that "a ratio μ1/μ2 of the first magnetic permeability μ1 to the second magnetic permeability μ2 changes within a range between 6-88%." More specifically, the ratio (μ1/μ2) was adjusted so as to vary by keeping the second magnetic permeability μ2 at a constant value (e.g., 160 or 80), and varying the first magnetic permeability μ1. The first magnetic permeability μ1 was adjusted by varying a relative density ρ1 of the coil-burying body 12 as described later. The relative density is a value obtained by dividing an actual density of a body obtained according to the well-known Archimedian method by a theoretical density of the body. It should be noted that the ferrite powders used for the coil-burying body 12 and the body for a closed magnetic circuit 13 of all the samples shown in Table 1 were Ni—Cu—Zn ferrite powders (supplied by Japan Metals & Chemicals Co., Ltd., Part Number JR21). The ferrite powders used for the coil-burying body 12 and the body for a closed magnetic circuit 13 of all the samples shown in Table 2 were another Ni—Cu—Zn ferrite powders (supplied by Japan Metals & Chemicals Co., Ltd., Part Number JR07).

It should be noted that the magnetic permeability can not be measured directly. Accordingly, the magnetic permeability μ1 and the magnetic permeability μ2 were obtained by measuring magnetic permeability of bulks (bodies) having the same magnetic permeability as well as the same grain diameter as the coil-burying body 12 and the body for a closed magnetic circuit 13, respectively. More specifically, the magnetic permeability μ1 and the magnetic permeability μ2 were obtained as follows.

The bulks were formed, each bulk having a toroidal (or ring) shape whose outer diameter, inner diameter, and thickness are 16.5 mm, 5.0 mm, and 4.2 mm, respectively.

An inductance of each of the thus formed bulks was measured at 1 M Hz using the LCR meter (supplied by Agilent, Part number 4285A, Electrodes for measuring magnetic material 1645A).

A relative magnetic permeability of each of the bulks was calculated based on the measured inductance.

The magnetic permeability μ1 or the magnetic permeability μ2 was estimated based on the calculated relative magnetic permeability.

The relative density ρ1 of the coil-burying body 12 was varied by adjusting an amount of the acrylic grains serving as the pore-forming agent. More specifically, the relative density ρ1 (and accordingly, the first magnetic permeability μ1) of the coil-burying body 12 was adjusted by varying an amount of the ferrite powders within a range between "a volume ratio of 25% (at this time, a volume ratio of the pore-forming agent is 20%) and 40% (at this time, a volume ratio of the pore-forming agent is 5%)" while retaining a total volume ratio of a mixture of "the ferrite powders and the pore-forming agent" at 45%.

A thickness t of the coil-burying body 12 is a distance between an outer end (outer circumference) of the coil 11 and an outer end (outer circumference) of the coil-burying body 12, and is also a distance between an inner end (inner circumference) of the coil 11 and an inner end of the coil-burying body 12 (i.e., the through-hole 12*a*) (refer to FIGS. 6 and 8). The thickness t is varied by adjusting the distance L2 and the distance L3 of the first mold 21 shown in FIG. 4.

FIGS. 9 to 12 are graphs showing the experimentally observed results of the superimposed DC current characteristics of the Samples 1 to 12 whose data are shown in Table 1. FIGS. 13 to 16 are graphs showing the experimentally observed results of the superimposed DC current characteristics of the Samples 21 to 32 whose data are shown in Table 2. It can be said that the superimposed DC current characteristic of a sample becomes better, as an inductance L of the sample becomes larger when a larger DC current Idc is flowed. Evaluation results in Table 1 and Table 2 are based on this view. In Table 1 and Table 2, the "x" indicates that the superimposed DC current characteristic of the sample was not better as compared to each reference sample (Sample 16 in Table 1, and Sample 36 in table 2, i.e. references), the "○" indicates that the superimposed DC current characteristic of the sample was better as compared to each reference sample, and the "Δ" indicates that the superimposed DC current characteristic of the sample was nearly equal to that of the respective reference samples. It should be noted that the each reference sample is an inductor comprising a coil 11 buried in a magnetic body having the second magnetic permeability μ2 without separating the coil-burying body from the magnetic body for a closed magnetic circuit. An outer shape of each of the references is identical to each of the other samples.

TABLE 1

| SAMPLE | Magnetic permeability: coil-burying body μ1 | Magnetic permeability: body for a closed magnetic circuit μ2 | Magnetic permeability: ratio μ1/μ2 | Relative density: coil-burying body ρ1 | Relative density: body for a closed magnetic circuit ρ2 | Relative density: ratio ρ1/ρ2 | thickness of coil-burying body t (mm) | Evaluation Results |
|---|---|---|---|---|---|---|---|---|
| 1 | 10 | 160 | 0.06 | 56% | 91% | 0.61 | 0.03 | X |
| 2 | 10 | 160 | 0.06 | 56% | 91% | 0.61 | 0.05 | X |
| 3 | 10 | 160 | 0.06 | 56% | 91% | 0.61 | 0.10 | X |
| 4 | 30 | 160 | 0.19 | 69% | 91% | 0.76 | 0.03 | ○ |
| 5 | 30 | 160 | 0.19 | 69% | 91% | 0.76 | 0.05 | ○ |
| 6 | 30 | 160 | 0.19 | 69% | 91% | 0.76 | 0.10 | Δ |
| 7 | 50 | 160 | 0.31 | 74% | 91% | 0.82 | 0.03 | ○ |
| 8 | 50 | 160 | 0.31 | 74% | 91% | 0.82 | 0.05 | ○ |
| 9 | 50 | 160 | 0.31 | 74% | 91% | 0.82 | 0.10 | ○ |
| 10 | 100 | 160 | 0.63 | 83% | 91% | 0.92 | 0.03 | ○ |
| 11 | 100 | 160 | 0.63 | 83% | 91% | 0.92 | 0.05 | ○ |
| 12 | 100 | 160 | 0.63 | 83% | 91% | 0.92 | 0.10 | ○ |
| 13 | 130 | 160 | 0.81 | 87% | 91% | 0.96 | 0.03 | unmeasurable |
| 14 | 130 | 160 | 0.81 | 87% | 91% | 0.96 | 0.05 | unmeasurable |
| 15 | 130 | 160 | 0.81 | 87% | 91% | 0.96 | 0.10 | unmeasurable |
| 16 | 160 | 160 | 1.00 | 91% | 91% | 1.00 | — | reference |

TABLE 2

| SAMPLE | Magnetic permeability: coil-burying body μ1 | Magnetic permeability: body for a closed magnetic circuit μ2 | Magnetic permeability: ratio μ1/μ2 | Relative density: coil-burying body ρ1 | Relative density: body for a closed magnetic circuit ρ2 | Relative density: ratio ρ1/ρ2 | thickness of coil-burying body t (mm) | Evaluation Results |
|---|---|---|---|---|---|---|---|---|
| 21 | 10 | 80 | 0.13 | 57% | 94% | 0.61 | 0.03 | X |
| 22 | 10 | 80 | 0.13 | 57% | 94% | 0.61 | 0.05 | X |
| 23 | 10 | 80 | 0.13 | 57% | 94% | 0.61 | 0.10 | X |
| 24 | 20 | 80 | 0.25 | 69% | 94% | 0.73 | 0.03 | ○ |
| 25 | 20 | 80 | 0.25 | 69% | 94% | 0.73 | 0.05 | ○ |
| 26 | 20 | 80 | 0.25 | 69% | 94% | 0.73 | 0.10 | Δ |
| 27 | 30 | 80 | 0.38 | 74% | 94% | 0.78 | 0.03 | ○ |
| 28 | 30 | 80 | 0.38 | 74% | 94% | 0.78 | 0.05 | ○ |
| 29 | 30 | 80 | 0.38 | 74% | 94% | 0.78 | 0.10 | ○ |
| 30 | 60 | 80 | 0.75 | 83% | 94% | 0.88 | 0.03 | ○ |
| 31 | 60 | 80 | 0.75 | 83% | 94% | 0.88 | 0.05 | ○ |
| 32 | 60 | 80 | 0.75 | 83% | 94% | 0.88 | 0.10 | ○ |
| 33 | 70 | 80 | 0.88 | 89% | 94% | 0.94 | 0.03 | unmeasurable |
| 34 | 70 | 80 | 0.88 | 89% | 94% | 0.94 | 0.05 | unmeasurable |
| 35 | 70 | 80 | 0.88 | 89% | 94% | 0.94 | 0.10 | unmeasurable |
| 36 | 80 | 80 | 1.00 | 94% | 94% | 1.00 | — | reference |

It is understood from the data, the inductance of each of the inductors, whose ratio (μ1/μ2) of the first magnetic permeability (μ1) to the second magnetic permeability (μ2) is equal to or greater than 0.19 and is smaller than or equal to 0.75, was larger than the inductance of the each reference sample, when a DC current flowing through the inductor was increased (refer to FIGS. 10-12, and FIGS. 14-16). That is, it is confirmed that an inductor whose superimposed DC current characteristic is better than that of the each reference sample can be obtained, if the ratio (μ1/μ2) is equal to or greater than 0.19 and is smaller than or equal to 0.75. In other words, an inductor whose superimposed DC current characteristic is better than that of the each reference sample was able to be manufactured, if the ratio (ρ1/ρ2) of the relative density (ρ1) of the coil-burying body 12 to the relative density (√2) of the body for a closed magnetic circuit 13 was equal to or greater than 0.73 and was smaller than or equal to 0.92.

Figure 9:
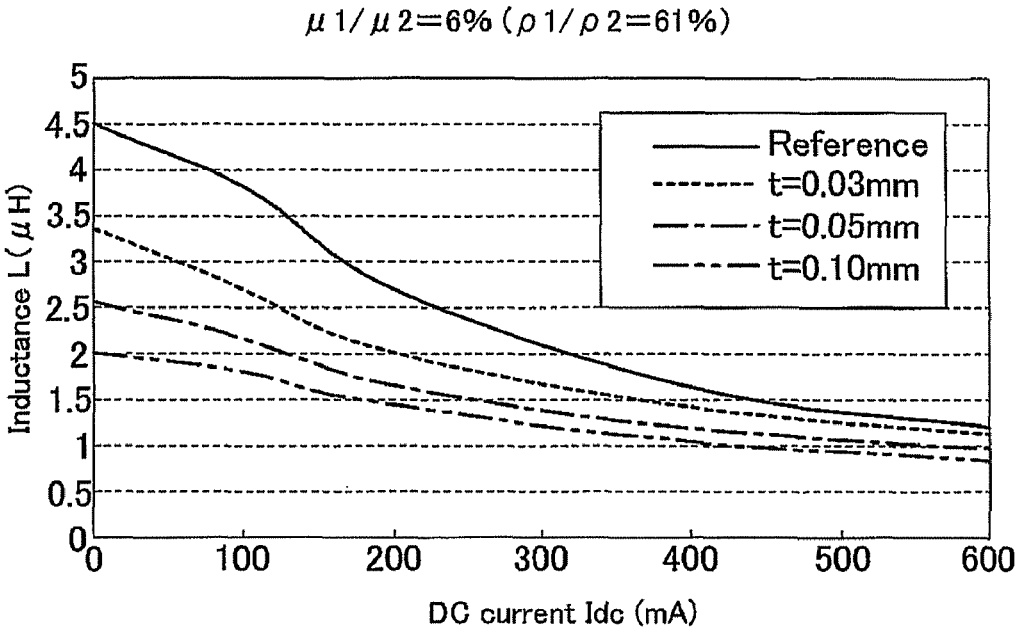
FIG. 9 is a graph showing characteristics of inductors ($\mu1/\mu2=0.06$) manufactured according to the first manufacturing method.
Figure 10:
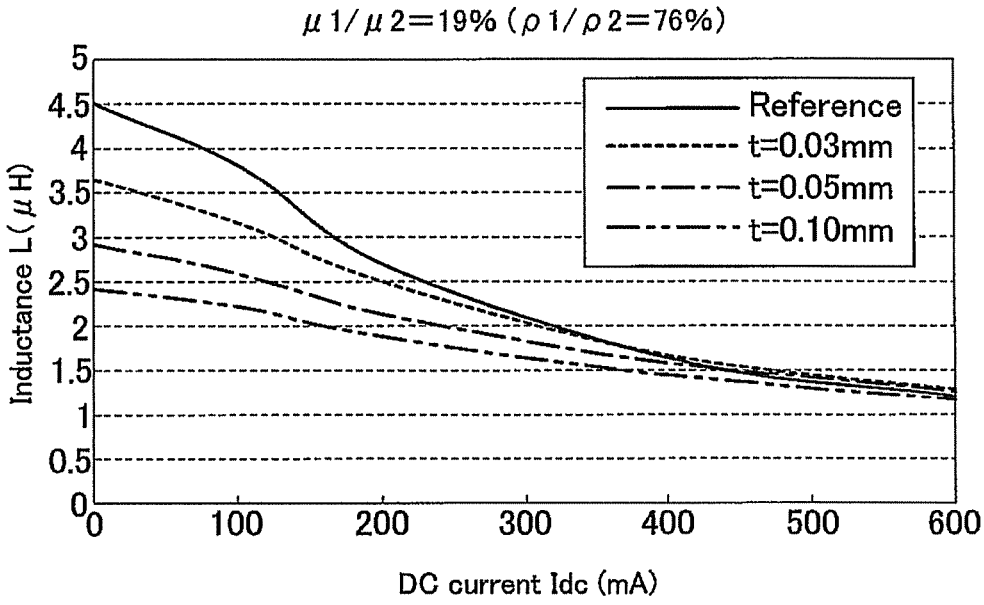
FIG. 10 is a graph showing characteristics of inductors ($\mu1/\mu2=0.19$) manufactured according to the first manufacturing method.
Figure 11:
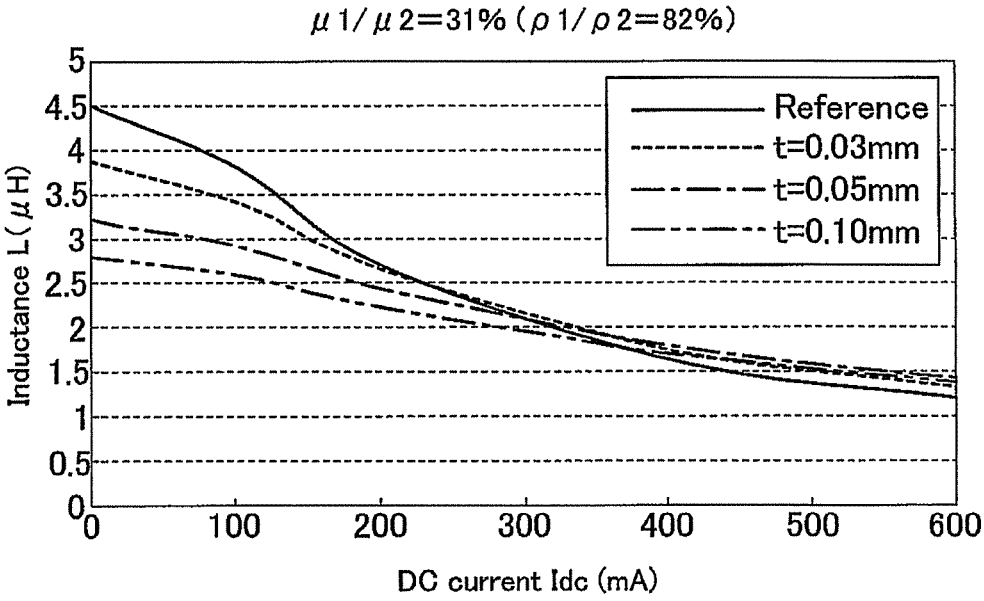
FIG. 11 is a graph showing characteristics of inductors ($\mu1/\mu2=0.31$) manufactured according to the first manufacturing method.
Figure 12:
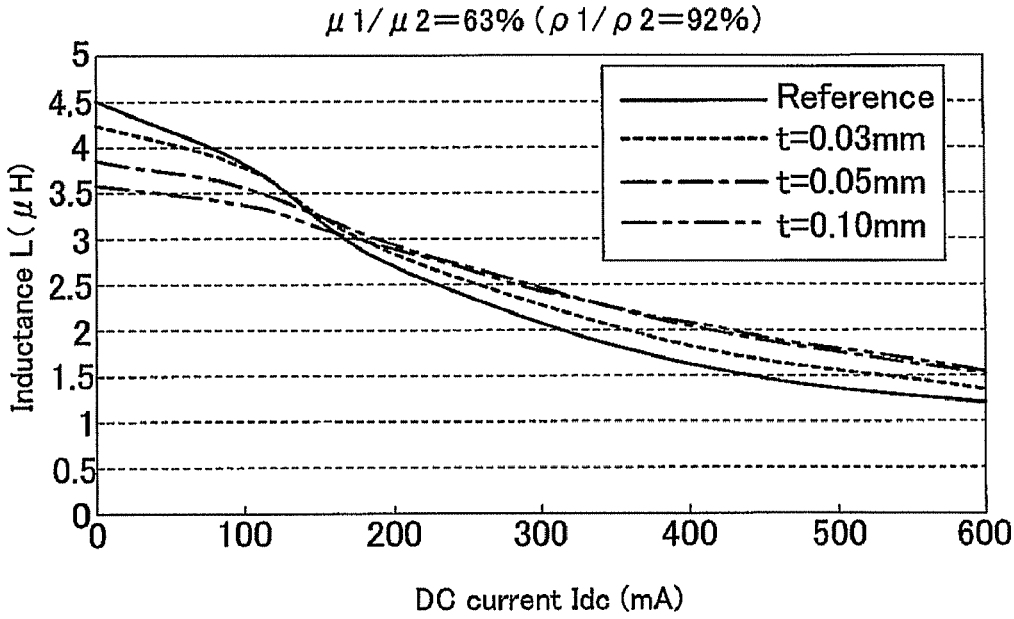
FIG. 12 is a graph showing characteristics of inductors ($\mu1/\mu2=0.63$) manufactured according to the first manufacturing method.
Figure 13:
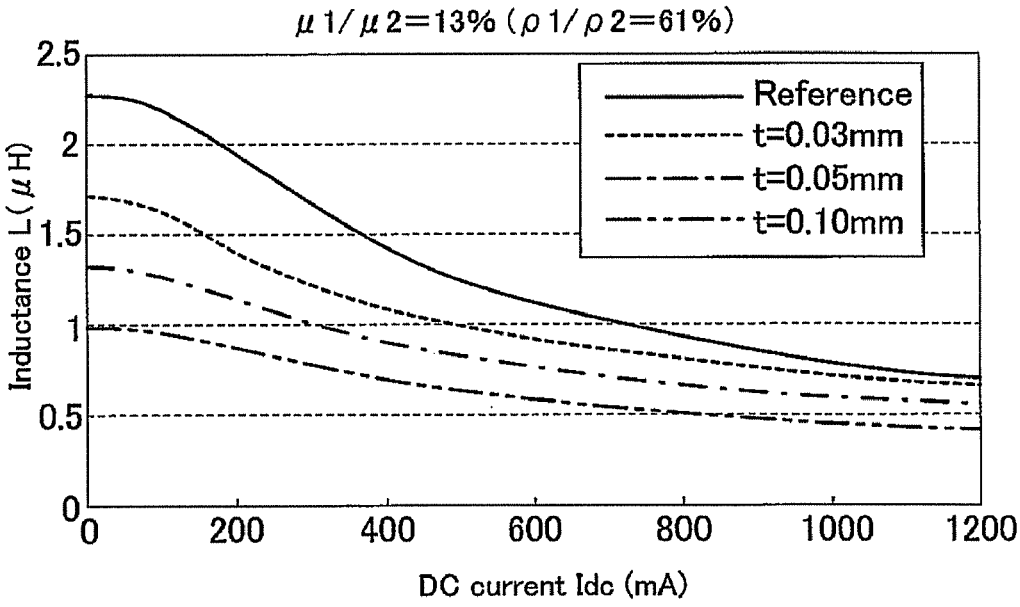
FIG. 13 is a graph showing characteristics of inductors ($\mu1/\mu2=0.13$) manufactured according to the first manufacturing method.
Figure 14:
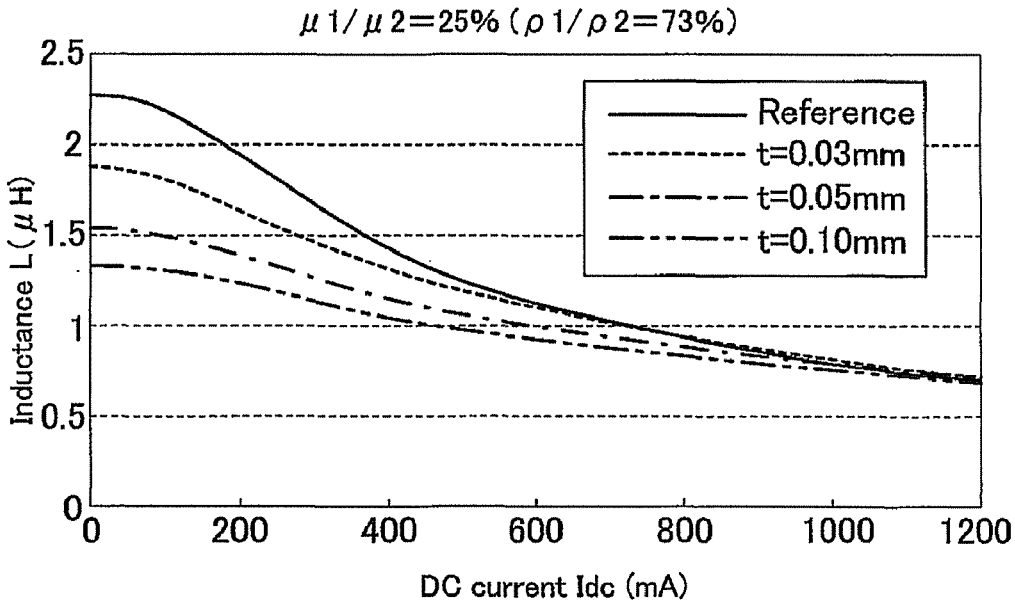
FIG. 14 is a graph showing characteristics of inductors ($\mu1/\mu2=0.25$) manufactured according to the first manufacturing method.
Figure 15:
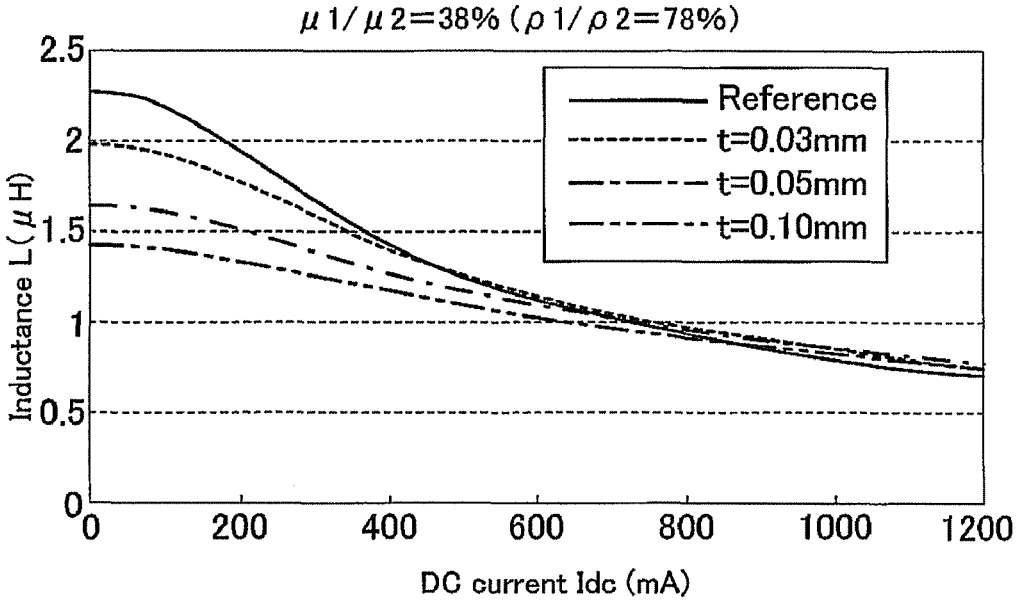
FIG. 15 is a graph showing characteristics of inductors ($\mu1/\mu2=0.38$) manufactured according to the first manufacturing method.
Figure 16:
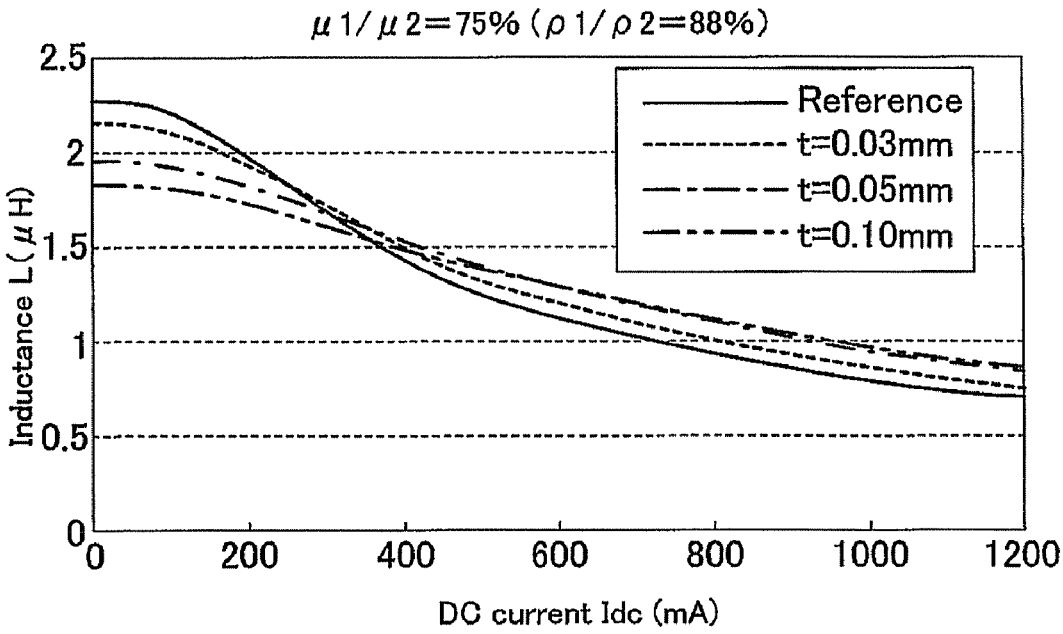
FIG. 16 is a graph showing characteristics of inductors ($\mu1/\mu2=0.75$) manufactured according to the first manufacturing method.

On the other hand, when the ratio (μ1/μ2) was equal to 0.06 as shown in FIG. 9, and when the ratio (μ1/μ2) was equal to 0.13 as shown in FIG. 13, the inductance was not greater than the inductance of the reference, even when the DC current flowing through the inductor was increased. In addition, when the ratio (μ1/μ2) was equal to 0.81 as shown in Table 1, and when the ratio (μ1/μ2) was equal to 0.88 as shown in Table 2, cracks occurred around the coil 11, the inductance was unable to be measured.

Further, although not shown in Table 1 and Table 2, when the thickness (t) of the coil-burying body 12 was smaller than 30 μm, cracks occurred in the coil-burying body 12 and the body for a closed magnetic circuit 13, the inductance was therefore unable to be measured. Furthermore, although not shown in Table 1 and Table 2, when the thickness (t) was greater than 100 μm, the inductance was reduced remarkably. This is probably because a distance between the body for a closed magnetic circuit 13 and the coil is excessively large, and the magnetic flux passing through the body for a closed magnetic circuit 13 therefore decreases. In view of the above, it is preferable that the thickness (t) be equal to or greater than 30 μm and be smaller than or equal to 100 μm.

It should be noted that the similar results described above were also confirmed when the relative density of the coil-burying body 12 was changed by adjusting the grain diameter of the material powders for the first ceramic slurry S1 which constitute the coil-burying body 12 (i.e., when the first magnetic permeability μ1 was changed).

<A Second Manufacturing Method>

Next will be described "a method for manufacturing the compact inductor inductors 10 (hereinafter, referred to as "a second manufacturing method") according to a second embodiment of the present invention. The second manufacturing method including:

(E) A coil-burying-body-before-fired forming process/step for forming (fabricating/making) a coil-burying-body-before-fired;

(F) An inductor-before-fired forming process/step for forming (fabricating/making) an inductor-before-fired; and (G) A firing process/step for firing the inductor-before-fired.

Each of the processes will be described hereinafter.

(E) The Coil-burying-body-before-fired Forming Process:

The coil-burying-body-before-fired forming process is a process for forming a coil-burying-body-before-fired with using ceramic green sheets, and includes:

(E1) a ceramic green sheets preparing process;

(E2) a thin conductive film forming process;

(E3) a coil forming/fabricating process (layering process); and (E4) a through-hole forming process.

It should be noted that the through-hole forming process (E4) may be a process for forming a through-hole passing through "layered (or laminated) ceramic green sheets" obtained by the coil forming process (E3) by a punching process and so on, or be a process for forming a through-hole passing through each of the ceramic green sheets by a punching process and so on before layering process in the coil forming process (E3).

Figure 17:
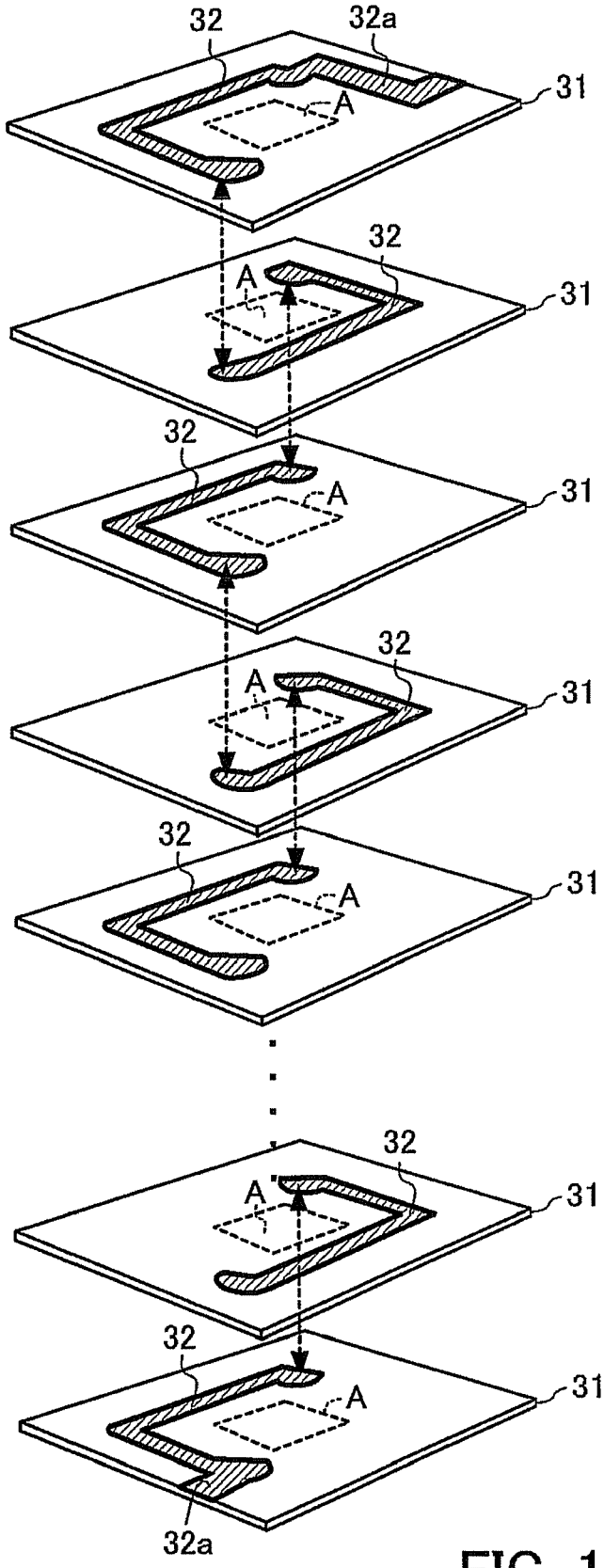
FIG. 17 depicts a coil-burying-body-before-fired forming process in a second method for manufacturing (a second manufacturing method) according to the present invention.

(E1) The Ceramic Green Sheets Preparing Process:

As shown in FIG. 17, a plurality of ceramic green sheets 31 are prepared. Each of the ceramic green sheets 31 is formed of a material containing ferrite grains (powders). Each of the ceramic green sheets 31 is a thin plate having a substantially rectangular shape. The ferrite grains (powders) contained in the ceramic green sheets 31 are adjusted in such a manner that "a magnetic permeability of a ceramic formed by firing the ceramic green sheets 31" becomes equal to the first magnetic permeability.

(E2) The Thin Conductive Film Forming Process:

As shown in FIG. 17, thin conductive films 32 are formed by printing and so on. Each of thin conductive films 32 is formed so as to have "a predetermined pattern which surrounds a predetermined area A shown by each dashed line in FIG. 17", on each of the prepared ceramic green sheets 31. In the present example, the predetermined pattern has a shape bending at a right angle along two sides of the rectangular ceramic green sheet 31, the two sides being adjacent to each other. It should be noted that patterns, each corresponding to electrode terminal 32*a*, are formed on the uppermost ceramic green sheet and on the lowermost ceramic green sheet among the ceramic green sheets 31 that will be layered in the following layering process. It should also be noted that the thin conductive film 32 may be formed on the ceramic green sheet 31 in such a manner that an upper surface of the thin conductive film 32 exists in a single plane where an upper surface (exposed surface) of the ceramic green sheet 31 exists.

(E3) The Coil Forming Process:

Subsequently, a layered body is formed by layering and pressure bonding the plurality of ceramic green sheets 31, on each of which the thin conductive film 32 is formed. At this time, the ceramic green sheets 31 are layered in such a manner that two of the thin conductive films 32 of two of the ceramic green sheets adjacent to each other form a closed curve which surrounds the predetermined area A, when transparently viewed in a direction perpendicular to the upper surface of the ceramic green sheet 31. This process is referred to as a layering process. Further, the two of the thin conductive films 32, 32 formed on the two of the ceramic green sheets adjacent to each other in the direction of layering are electrically connected together with "a via hole" (refer to dashed arrow lines in FIG. 17). As a result, "a coil made of a helically wound conductor" is formed. The connection using the via hole can be realized by, for example, forming the via hole at a predetermined position (beneath the thin conductive film 32) of the ceramic green sheet 31 and filling the via hole with a metal made of the same material as the thin conductive film 32.

Figure 18:
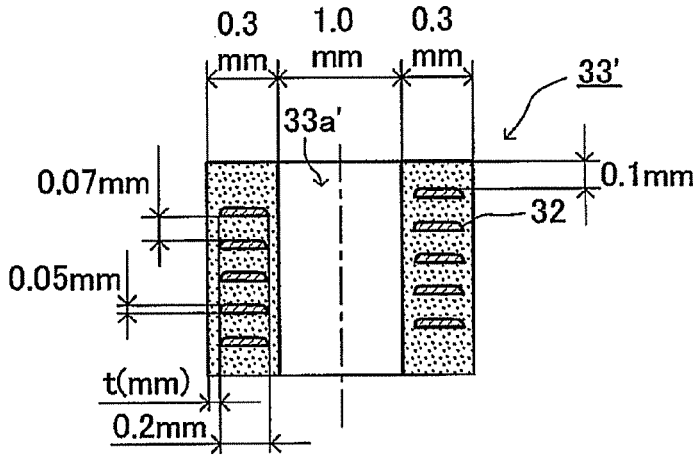
FIG. 18 is a vertical cross-sectional view of a coil-burying-body-before-fired formed at a middle/intermediate stage of the second manufacturing method.

(E4) The Through-hole Forming Process:

As shown in FIG. 18, a through-hole 33*a*' is formed at the predetermined area A of the layered body by "die-cutting". As a result, the coil-burying-body-before-fired 33' which has a substantially rectangular parallelepiped shape is formed.

(F) The Inductor-before-fired Forming Process:

This inductor-before-fired forming process includes the substantially same processes as ones that the above described inductor-before-fired forming process (C) of the first manufacturing method includes. That is, this inductor-before-fired forming process includes, (F1) a mold preparing process;

(F2) a coil-burying-body-before-fired placing process;

(F3) a cast molding process; and (F4) a hardening process.

Figure 19:
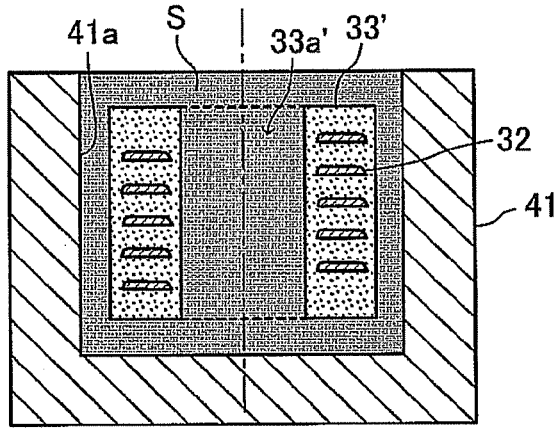
FIG. 19 is a view including a vertical cross-sectional view of a mold used in the second manufacturing method.

(F1) The Mold Preparing Process:

A mold 41 shown in FIG. 19 is prepared. The mold 41 has a concave portion 41*a* (a space 41*a*) for holding/storing the coil-burying-body-before-fired 33'. A shape of the concave portion 41*a* has a substantially rectangular parallelepiped shape similar to the shape of the coil-burying-body-before-fired 33'. The concave portion 41*a* is a space larger than a shape defined by an outer circumference of the coil-burying-body-before-fired 33'.

(F2) The Coil-burying-body-before-fired Placing Process:

The coil-burying-body-before-fired 33' is placed within the mold 41. At this time, the coil-burying-body-before-fired 33' is arranged so as to be coaxial with the concave portion 41*a*. Further, the coil-burying-body-before-fired 33' is placed so as to be apart, by a predetermined distance, from wall surfaces of the concave portion 41*a*. That is, the coil-burying-body-before-fired 33' is held or supported within the mold 41 in such a manner that the body 33' does not contact with the mold 41. In addition, the coil-burying-body-before-fired 33' is arranged so as to be completely inside of the concave portion 41*a*.

(F3) The Cast Molding Process:

First, a ceramic slurry S is prepared. The ceramic slurry S is prepared in the same way as the above described second ceramic slurry S2. The ceramic slurry S is a ceramic slurry containing the magnetic powders and having "the heat-gelling characteristic or the thermoset characteristic," the ceramic slurry S being adjusted in such a manner that a magnetic permeability of a body obtained by drying and firing the ceramic slurry S becomes equal to "the second magnetic permeability greater than the first magnetic permeability."

Subsequently, as shown in FIG. 19, the ceramic slurry S is poured/put into the mold 41 (the concave portion 41*a*). It should be noted that a mold release agent is applied to surfaces of the concave portion 41*a* of the mold 41 in advance. As a result, the ceramic slurry S exists densely at an outer circumference portion of the coil-burying-body-before-fired 33' and in the through-hole 33*a*'. This is the cast molding process.

(F4) The Hardening Process:

Thereafter, the ceramic slurry S is held/kept in the mold 41 for 24 hours, similarly to the second hardening process described above. During this period, the ceramic slurry S gelates. Subsequently, the ceramic slurry S which has gelated is dried by leaving the slurry S in a temperature of 130° C. for 4 hours. As a result, a hardened body made of the hardened gel is formed. After that, the hardened body is taken out from the mold 41 (the mold is released). That is, the hardening process is a process in which the ceramic slurry S poured into the mold 41 is changed so that the slurry S can keep its shape (i.e., the slurry S gelates or is hardened by heat).

Figure 20:
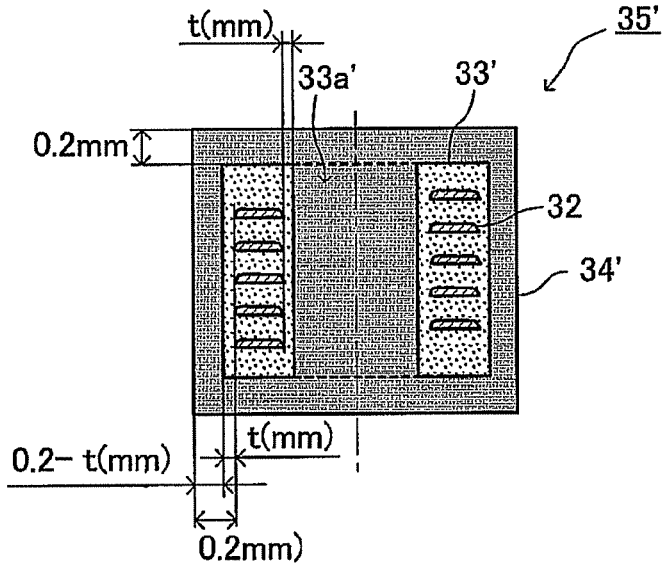
FIG. 20 is a vertical cross-sectional view of an inductor-before-fired formed at a middle/intermediate stage of the second manufacturing method.

As a result, an inductor-before-fired 35' comprising "the coil-burying-body-before-fired 33' and the body for a closed magnetic circuit before fired 34' in which the coil-burying-body-before-fired 33' is buried" shown in FIG. 20 is formed/fabricated.

(G) The Firing Process for Firing the Inductor-before-fired:

Subsequently, the inductor-before-fired 35' is fired according to the conditions similar to the conditions described in the firing process (D) or to the conventional conditions (an environmental temperature is gradually increased up to 900 from 500° C. which is the degreasing temperature, for about 5 hours). As a result, a compact inductor (an inductor 35 comprising the coil 32, the coil-burying body 33, and the body for a closed magnetic circuit 34), similar to the compact inductor 10 shown in FIG. 1, is formed/fabricated. It should be noted that the shape of the compact inductor 35 is substantially rectangular parallelepiped, and the coil 32 is formed of the thin-plate like sintered metal.

Table 3 shows evaluation results of the compact inductors manufactured according to the second manufacturing method. The magnetic permeability of the coil-burying body 33 (the first magnetic permeability μ1) is varied by adjusting a relative density ρ1 of the coil-burying body 33. In Sample 1 shown in Table 3, "the ratio (μ1/μ2) of the first magnetic permeability μ1 to the second magnetic permeability μ2" was 0.34. In Sample 1, the ratio (ρ1/ρ2) of the relative density ρ1 of the coil-burying body 33 to the relative density ρ2 of the body for a closed magnetic circuit 34 was 0.85. It should be noted that the first magnetic permeability μ1 and the second magnetic permeability μ2 were calculated from values of the bulks, similarly to the above described method. Further, the relative density ρ1 of the coil-burying body 33 was varied by adjusting an amount of acrylic grains serving as the pore-forming agent. More specifically, in the slurry for forming the ceramic green sheet 31, a volume ratio of the pore-forming agent with respect to the ferrite powders was 25%. Sample 2 in Table 3 is a reference sample. The reference sample is an inductor comprising the coil 32 buried in a magnetic body having the second magnetic permeability μ2 without separating the coil-burying body from the magnetic body for a closed magnetic circuit. An outer shape of the reference sample is identical to a shape of Sample 1 in Table 3.

TABLE 3

| | Magnetic permeability | | | Relative density | | | | |
|---|---|---|---|---|---|---|---|---|
| SAMPLE | coil-burying body μ1 | body for a closed magnetic circuit μ2 | ratio μ1/μ2 | coil-burying body ρ1 | body for a closed magnetic circuit ρ2 | ratio ρ1/ρ2 | thickness of coil-burying body t (mm) | Evaluation Results |
| 1 | 55 | 160 | 0.34 | 74% | 91% | 0.82 | 0.05 | ○ |
| 2 | 160 | 160 | 1.00 | 91% | 91% | 1.00 | — | reference |

Figure 21:
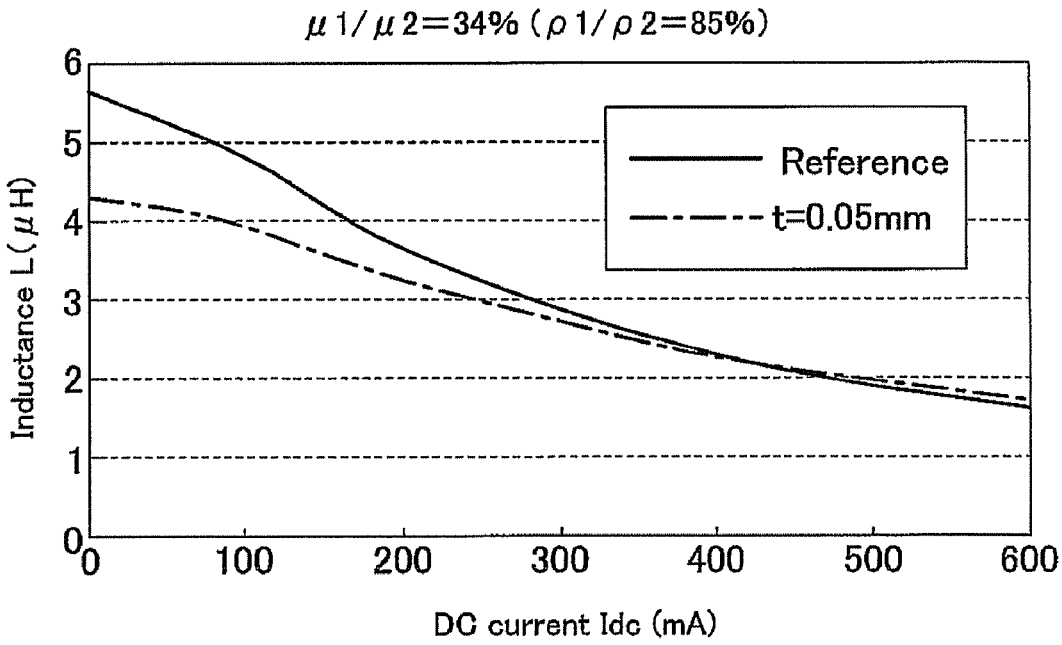
FIG. 21 is a graph showing characteristics of inductors ($\mu1/\mu2=0.34$) manufactured according to the second manufacturing method.

FIG. 21 is a graph showing inductance L of Sample 1 and Sample 2 whose data are shown in Table 3. It is clear from FIG. 21 and Table 3, the inductance of Sample 1 became greater than the inductance of Sample 2 (the reference sample), when a DC current Idc flowing through the inductor was increased. That is, it is confirmed that an inductor whose superimposed DC current characteristic is excellent can be obtained, by the second manufacturing method as well.

As described above, according to the second manufacturing method, "the coil-burying-body-before-fired 33'" can easily be manufactured with using ceramic green sheets through "(E) the coil-burying-body-before-fired forming process" including processes similar to processes included in "the conventional layered inductor manufacturing method".

Further, in the second manufacturing method as well, the body for a closed magnetic circuit before fired 34' is formed by using the gelcast method in the inductor-before-fired forming process (F). Accordingly, since the body for a closed magnetic circuit before fired 34' is hard to shrink while drying the body for a closed magnetic circuit before fired 34', no crack occurs in the body for a closed magnetic circuit before fired 34'. Further, "the inductor-before-fired 35'" is fired in the firing process for firing the inductor-before-fired (G), the inductor-before-fired 35' comprising the body for a closed magnetic circuit before fired 34' in which the coil-burying-body-before-fired. 33' is stored. It is therefore possible to easily fabricate a substantially dense body for a closed magnetic circuit having the second magnetic permeability "around the outside of the coil-burying body and in the through hole". That is, it is also possible to easily form/fabricate "the compact inductor according to the present invention" having the structure described above, according to the second manufacturing method.

The embodiments of the compact inductors of the present invention and the methods for manufacturing the compact inductors of the present invention are described above. According to these embodiments, the high-performance compact inductors can easily be manufactured. It should be noted that the present invention is not limited to the above embodiments, but may be modified as appropriate without departing from the scope of the invention. For example, the cross sectional view of the coil 11 cut by the plane perpendicular to the extending axis of the winding (in a direction of the axis of the coil) is not limited to the circular shape, but may be oval, square, rectangular, and so on. In other words, the outer shape of the helically wound conductor is not limited to the cylindrical column, but may be a rectangular parallelepiped, a truncated cone, and so on. The helically wound winding means to include a spiral winding.

Meanwhile, a ferrite body in which a conductor, which is made of a pure metal wire having a predetermined cross sectional area and is formed to have a predetermined shape (e.g., a coil-like shape), is buried, the body being manufactured according to the manufacturing methods described in the present specification, can be applied to products as follows.

<LC Filter>

There has been a known product referred to as "an LC filter", which is a complex of a layered condenser and a layered inductor, the LC filter being a product obtained by simultaneously firing the layered condenser and the layered inductor. The inductor of the LC filter can be manufactured by burying the pure metal wire according to the manufacturing method described in the present application. This allows concave and convex portions of a surface of a conductor (the metal) to be smaller (i.e., the surface of the conductor can be made much smoother). It is therefore possible to reduce a loss due to a concentration of a current on the surface of the conductor (i.e., a skin effect), when the LC filter is operated in a microwave region (or high frequency region). Further, since the coil made of the pure metal is dense, it does not include impurities such as a flux or pores, as compared to a sintered conductor formed of a conductive paste, it is possible to lower the resistance. Furthermore, a structure in which ends of the pure metal wires of the inductor are projected toward the condenser section may be formed, and this structure allows a joint strength at a boundary face between the condenser section and the inductor section to be increased by an anchor effect. Accordingly, this structure is preferable because it can enhance a reliability of the element.

Figure 22:
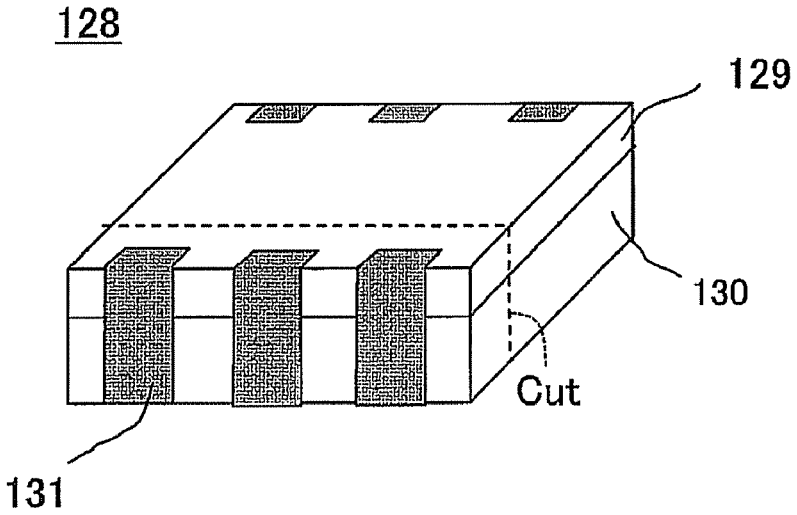
FIG. 22 is a perspective view of a LC filter which is one of embodiments to which the present invention is applied.
Figure 23:
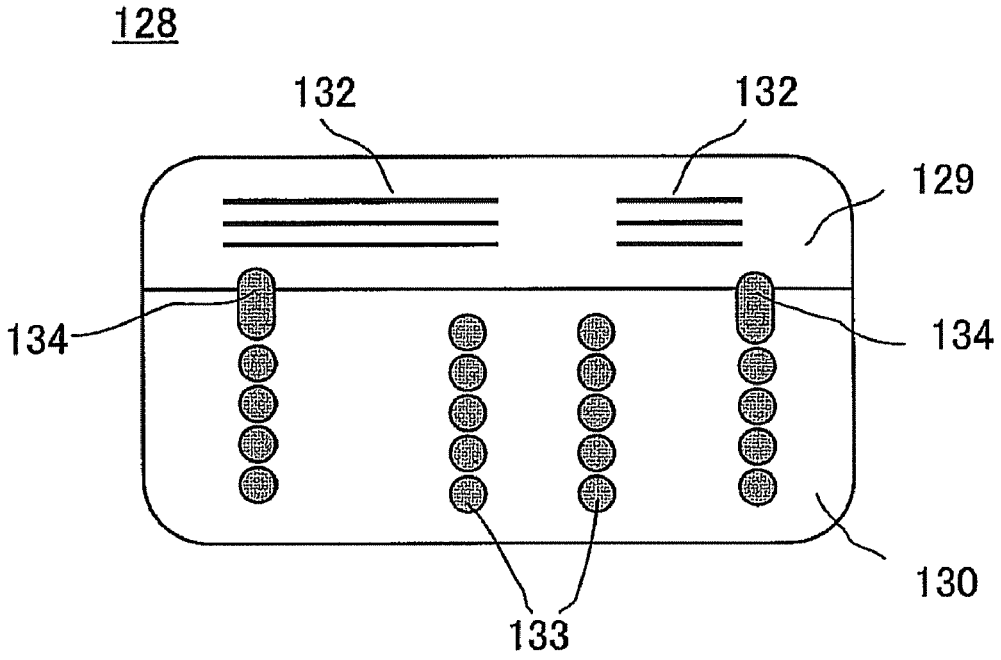
FIG. 23 is a vertical cross-sectional view of the LC filter, cut by a plane along Cut line shown in FIG. 22.
Figure 24:
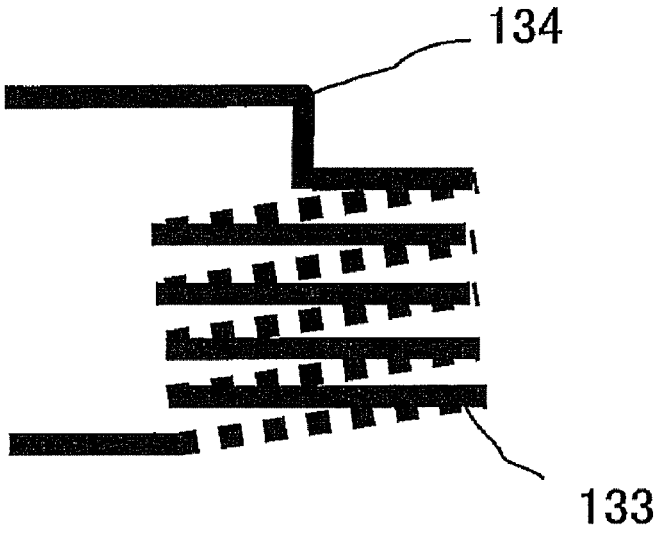
FIG. 24 is a transparent view of a right side of the LC filter shown in 22 to show a shape of a coil.

FIGS. 22-24 show an example of the LC filter to which the present invention is applied. It should be noted that the illustrated filter is an example, and the embodiment is therefore not limited to the example. FIG. 22 is a perspective view of a LC filter 128 which is one of examples to which the present invention is applied, the LC filter 128 comprising a condenser section 129, an inductor section 130, and terminals 131.

FIG. 23 is a cross-sectional view of the LC filter, cut by a plane along the Cut line shown in FIG. 22. Conductors 132 are formed in the condenser section 129 and a coil-like metal wire 133 is formed in the inductance section 130. End portions 134 of the metal wire 133 are projected into the condenser 129.

FIG. 24 is a transparent view of a right side of the LC filter shown in 22 to show a shape of the coil. The end portion 134 of the coil projects upwardly (toward the condenser section). This projected end portion 134 enhances a joint strength between the condenser section and the inductor section.

<A Ferrite Bar Antenna for Near Field Radio Communication>

According to the manufacturing method described in the present application, an embodiment in which a part of a coil is buried in a ferrite body can be manufactured. As one of advantages of this embodiment, for example, in an antenna having a ferrite bar around which a conductive wire is wound, a part of the coil can be buried in the ferrite bar. This provides a closed magnetic circuit at a portion in which the part of the coil is buried. Accordingly, the embodiment can be used as an antenna having a great directivity. Further, compassing a surface from which a magnetic flux is emitted in a form of concave enhances not only the directivity but also the sensitivity. Applications of this embodiment may include a device for Near Field Radio Communication, such as a RFID (radio-frequency identification device, noncontact automatic identification technique using electromagnetic wave), an antenna for receiving a long wave used, for example, for an atomic radio clock, and AM/FM antenna, and so on.

Figure 25:
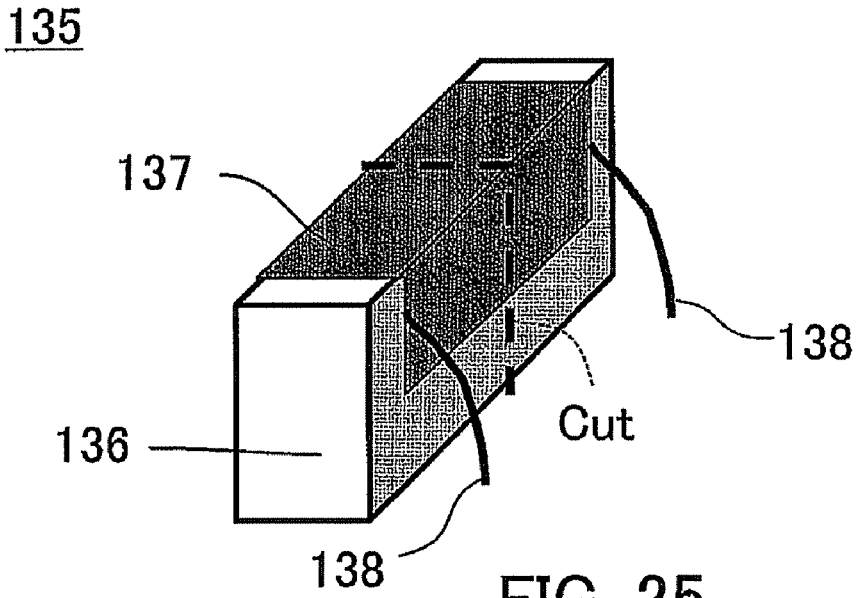
FIG. 25 is a perspective view of a ferrite bar antenna to which the present invention is applied.
Figure 26:
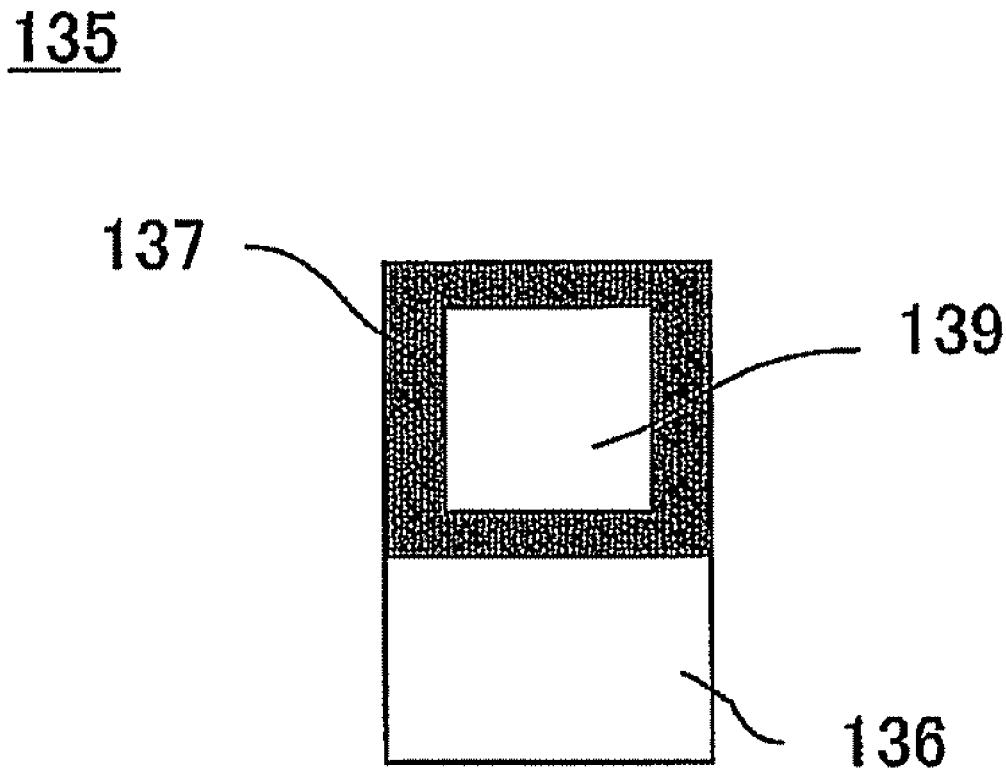
FIG. 26 is a vertical cross-sectional view of the ferrite bar antenna, cut by a plane along Cut line shown in FIG. 25.
Figure 27:
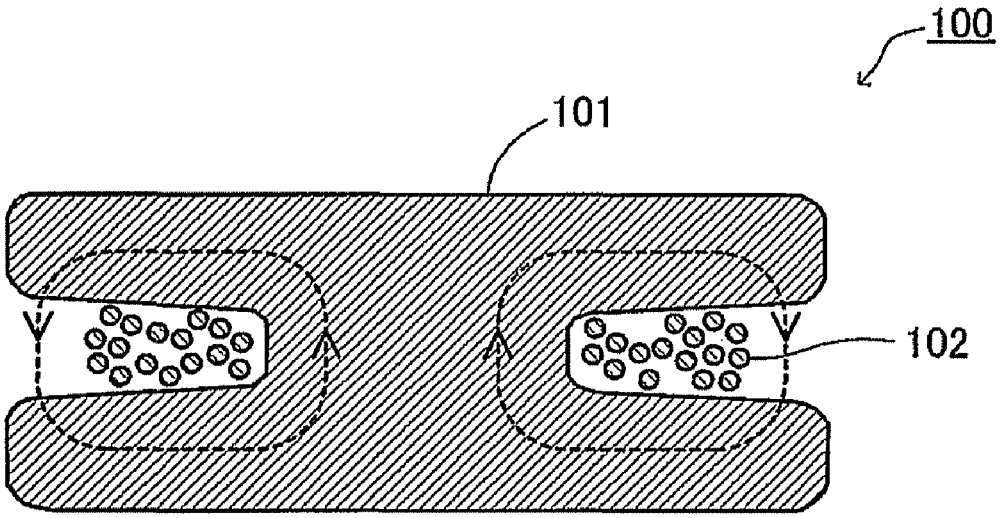
FIG. 27 is a vertical cross-sectional view of a conventional wirewound inductor.
Figure 28:
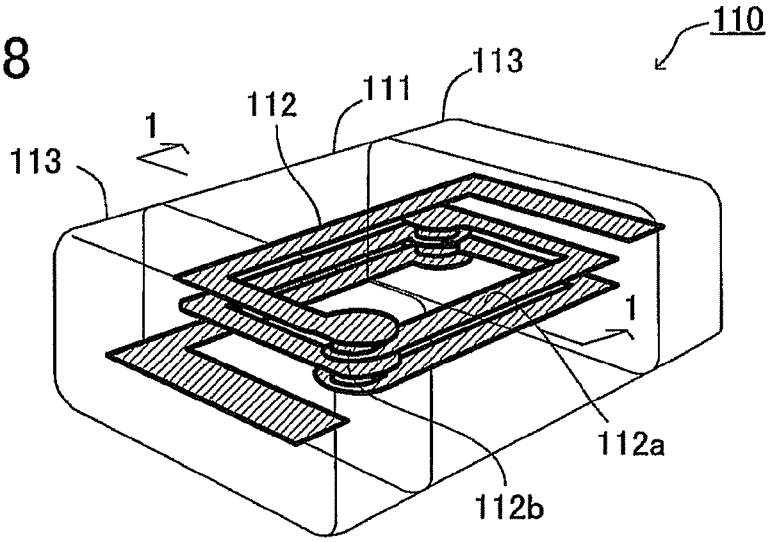
FIG. 28 is a perspective view of a conventional layered inductor.
Figure 29:
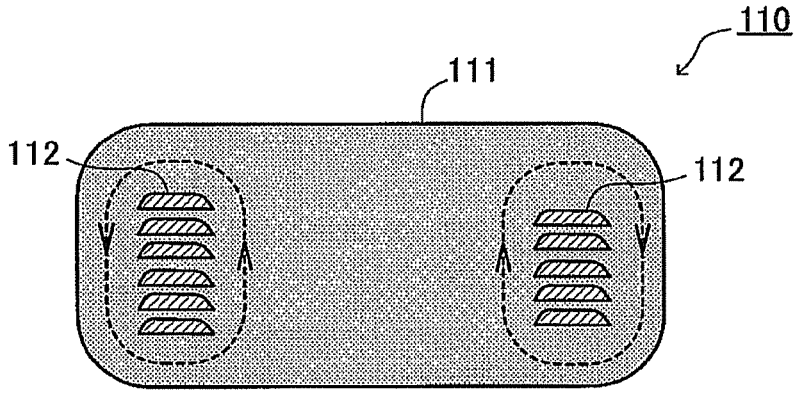
FIG. 29 is a cross-sectional view of the layered inductor shown in FIG. 28.
Figure 30:
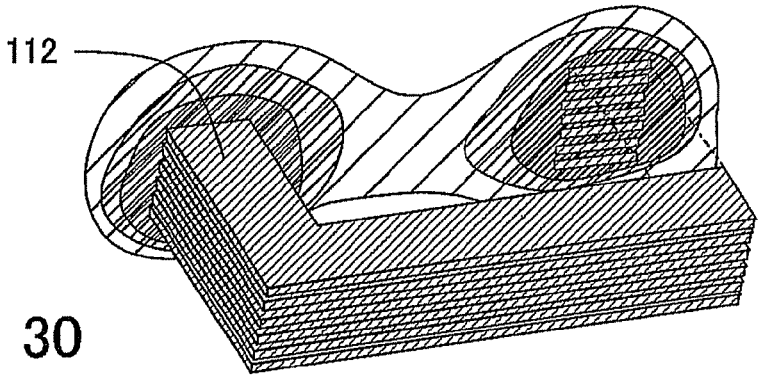
FIG. 30 is a view showing magnetic flux density in the layered inductor shown in FIG. 28.
Figure 31:
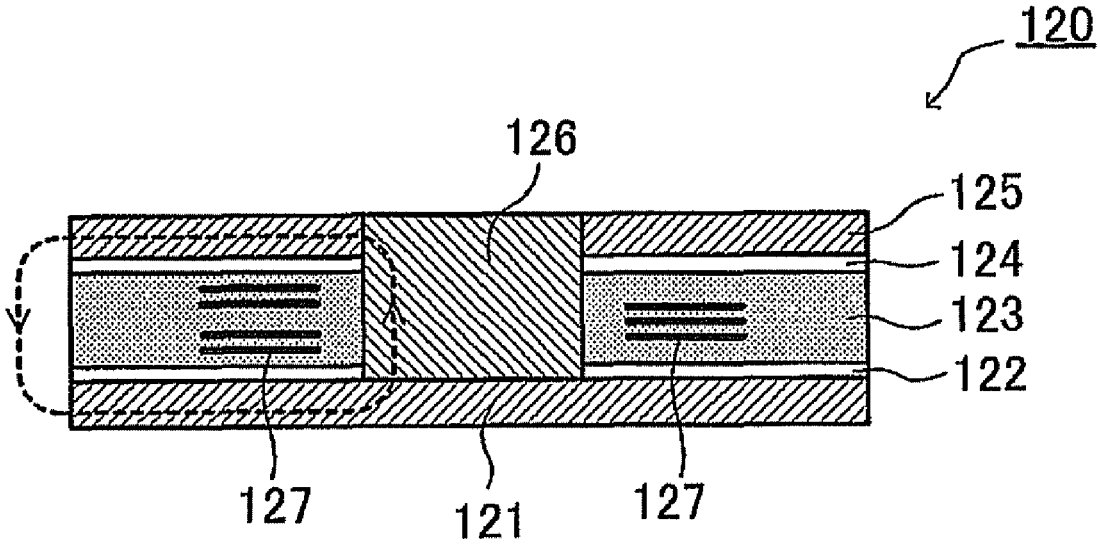
FIG. 31 is a cross-sectional view of another layered inductor modified to avoid occurring of a magnetic saturation.

FIGS. 25 and 26 show an embodiment of an antenna to which the present invention is applied. It should be noted that the illustrated antenna is an example, and the embodiment is not limited to it. FIG. 25 is a perspective view of a ferrite bar antenna 135 to which the present invention is applied, the antenna 135 comprising a ferrite section 136 and a coil section 137.

The coil section 137 is a coil having conductive wire that is wound a few tens to a few thousand of turns. Both ends 138 of the coil are exposed outside.

FIG. 26 is a vertical cross-sectional view of the ferrite bar antenna, cut by a plane along the Cut line shown in FIG. 25. A part of the coil 137 is buried in the ferrite section 136. The ferrite section 136 located outside of the coil 137 is in close contact with the coil 137, and the magnetic flux at the side of the close contact portion between the ferrite section and the coil 137 is therefore confined. In the present embodiment, 25% of a length of the circumference of the coil 137 is buried. If less than 10% of the length of the circumference of the coil 137 is buried, an effect of confining the magnetic flux is reduced. If more than 50% of the length of the circumference of the coil 137 is buried, a magnetic flux which is emitted outside is reduced. Accordingly, it is preferable that the coil 137 be buried in the ferrite section 136 within a rage between 10 to 50%.

A magnetic permeability of a ferrite section (core portion) 139 surrounded by the coil 137 may be different from a magnetic permeability of the ferrite section 136 located outside of the coil 137.

<An Antenna for Bluetooth>

The manufacturing methods described in the present application can provide an antenna in which a coil-like conductor is formed in a dielectric body, the coil-like conductor being a pure metal wire which is buried in the dielectric body. This allows concave and convex portions of a surface of the conductor (the metal) to be smaller (i.e., the surface of the conductor can be made much smoother). It is therefore possible to reduce a loss due to a concentration of a current on the surface of the conductor (i.e., a skin effect), when the antenna is operated in a microwave region (or high frequency region). Further, since the coil made of the pure metal is dense and does not include impurities such as a flux or pores, as compared to a sintered conductor formed of a conductive paste, it is possible to lower the resistance. Furthermore, since the conductive coil is formed in advance, it is possible to vary a cross-sectional shape of the coil (such as circular or rectangular) and to vary a shape in a longitudinal direction of the coil (such as shapes other than a linear shape) as appropriate, and the possibility of design can therefore be expanded. Therefore, not only the dielectric body but also a magnetic body can be used as a ceramics in which the conductor is buried. In both cases, the antenna can be made smaller because of wavelength shortening effect.

<A Diplexer/duplexer>

According to the manufacturing methods described in the present application, it is possible for a diplexer/duplexer, wherein a condenser section in which thin conductive plates are formed in a dielectric body and an inductor section in which a coil-like conductor is formed are united (integrated) to use a pure metal wire for the coil-like conductor. This allows concave and convex portions of a surface of the conductor to be smaller (i.e., the surface of the conductor can be made much smoother). It is therefore possible to reduce a loss due to a concentration of a current on the surface of the conductor (i.e., a skin effect), when the diplexer/duplexer is used in the microwave region (or the high frequency region). Further, since a magnetic body can be used instead of the dielectric body in the inductor section, it is possible to increase the inductance. As a result, the diplexer/duplexer can be greatly downsized.

The invention claimed is:

1. A compact inductor comprising:

a helically wound coil made of a conductor;

a coil-burying body made of a fired ceramic having a first magnetic permeability, in which said coil is buried and a through-hole passing through inside of said coil along an axis of said coil is formed; and a body for a closed magnetic circuit made of a fired ceramic having a second magnetic permeability greater than said first magnetic permeability, which are densely arranged at an outer circumference portion of said coil-burying body and in said through-hole so as to provide a closed magnetic circuit having no cut section for said coil by burying said coil-burying body.

2. A compact inductor according to claim 1, wherein said coil-burying body is made of a porous ceramic.

3. A compact inductor according to claim 1, wherein a ratio ($\mu1/\mu2$) of said first magnetic permeability ($\mu1$) to said second magnetic permeability ($\mu2$) is equal to or greater than 0.19 and is smaller than or equal to 0.75.

4. A compact inductor according to claim 1, wherein both of said coil-burying body and said body for a closed magnetic circuit are made of porous ceramic bodies, in which the same kind powders having the same diameter are dispersed, and a ratio ($\rho1/\rho2$) of a relative density ($\rho1$) of said coil-burying body to a relative density ($\rho2$) of said body for a closed magnetic circuit is equal to or greater than 0.73 and is smaller than or equal to 0.92, when said relative density is defined as a ratio of an actual density to a theoretical density.

5. A compact inductor according to claim 1, wherein a distance between an outer circumference of said coil and an outer circumference of said coil-burying body is the same as a distance between an inner circumference of said coil and an inner circumference of said coil-burying body; and a thickness (t) of said coil-burying body which is equal to said distance is equal to or greater than 30 μm and is smaller than or equal to 100 μm.

6. A compact inductor according to claim 2, wherein a distance between an outer circumference of said coil and an outer circumference of said coil-burying body is the same as a distance between an inner circumference of said coil and an inner circumference of said coil-burying body; and a thickness (t) of said coil-burying body which is equal to said distance is equal to or greater than 30 μm and is smaller than or equal to 100 μm.

7. A compact inductor according to claim 3, wherein a distance between an outer circumference of said coil and an outer circumference of said coil-burying body is the same as a distance between an inner circumference of said coil and an inner circumference of said coil-burying body; and a thickness (t) of said coil-burying body which is equal to said distance is equal to or greater than 30 μm and is smaller than or equal to 100 μm.

8. A compact inductor according to claim 4, wherein a distance between an outer circumference of said coil and an outer circumference of said coil-burying body is the same as a distance between an inner circumference of said coil and an inner circumference of said coil-burying body; and a thickness (t) of said coil-burying body which is equal to said distance is equal to or greater than 30 μm and is smaller than or equal to 100 μm.

* * * * *